US006743125B2

(12) United States Patent
O'Neill et al.

(10) Patent No.: US 6,743,125 B2
(45) **Date of Patent: *Jun. 1, 2004**

(54) TRANSPORTABLE BASKETBALL SYSTEM HAVING WIND-TRANSMISSIVE MESH BACKBOARD STRUCTURE AND SAND-ANCHORABLE POST ASSEMBLY

(76) Inventors: Raymond O'Neill, 27 Linden Dr., Spring Lake Heights, NJ (US) 07762; Raymond O'Neill, Jr., 27 Horker Hill Dr., Hamburg, NJ (US) 07449

( * ) Notice: Subject to any disclaimer, the term of this patent is extended or adjusted under 35 U.S.C. 154(b) by 0 days.

This patent is subject to a terminal disclaimer.

(21) Appl. No.: 10/314,903

(22) Filed: Dec. 9, 2002

(65) Prior Publication Data

US 2003/0144093 A1 Jul. 31, 2003

Related U.S. Application Data

(63) Continuation of application No. 09/535,837, filed on Mar. 28, 2000, now Pat. No. 6,575,853.

(51) Int. Cl.[7] ..... A63B 63/08
(52) U.S. Cl. ..... 473/481
(58) Field of Search ..... 473/481, 470, 473/492, 472, 476, 482, 483, 479

(56) References Cited

U.S. PATENT DOCUMENTS

| | | | |
|---|---|---|---|
| 3,960,378 | A | 6/1976 | Bahr |
| 4,131,283 | A | 12/1978 | Havlik |
| 4,373,720 | A | 2/1983 | Lombardi et al. |
| 4,468,027 | A | 8/1984 | Pangburn |
| 4,826,162 | A | 5/1989 | Allen |
| 4,979,754 | A | 12/1990 | Eisenhart |
| 5,133,546 | A | 7/1992 | Matherne et al. |
| 5,158,281 | A | 10/1992 | Williams |
| 5,255,910 | A | 10/1993 | Simonseth |
| 5,476,260 | A | 12/1995 | Ottley |
| D369,633 | S | 5/1996 | Taylor et al. |
| 5,615,890 | A | 4/1997 | Blue |
| 5,888,153 | A | 3/1999 | Masin |
| 5,895,169 | A | 5/1999 | Holm et al. |
| 5,902,197 | A | 5/1999 | Davis et al. |
| 5,913,778 | A | 6/1999 | Hying et al. |
| 5,947,847 | A | 9/1999 | van Nimwegen et al. |
| 6,196,938 | B1 | 3/2001 | Wiedner |

FOREIGN PATENT DOCUMENTS

| | | | |
|---|---|---|---|
| FR | 2 706 778 | 12/1994 | ..... A63B/63/08 |

OTHER PUBLICATIONS

Welcome to World Beach Basketball by World Beach Basketball Association, http://www.beachbasketball.com, 1900.

2001 PCT Search Report for International Application No. PCT/US01/09933.

*Primary Examiner*—Gregory Vidovich
*Assistant Examiner*—M. Chambers
(74) *Attorney, Agent, or Firm*—Thomas J. Perkowski, Esq. P.C.

(57) ABSTRACT

A transportable basketball system having a wind-transmissive backboard structure and sand-anchorable post assembly with threads and handles for safe, simple and quick installation along beaches, shorelines and other sand-covered outdoor environments.

6 Claims, 19 Drawing Sheets

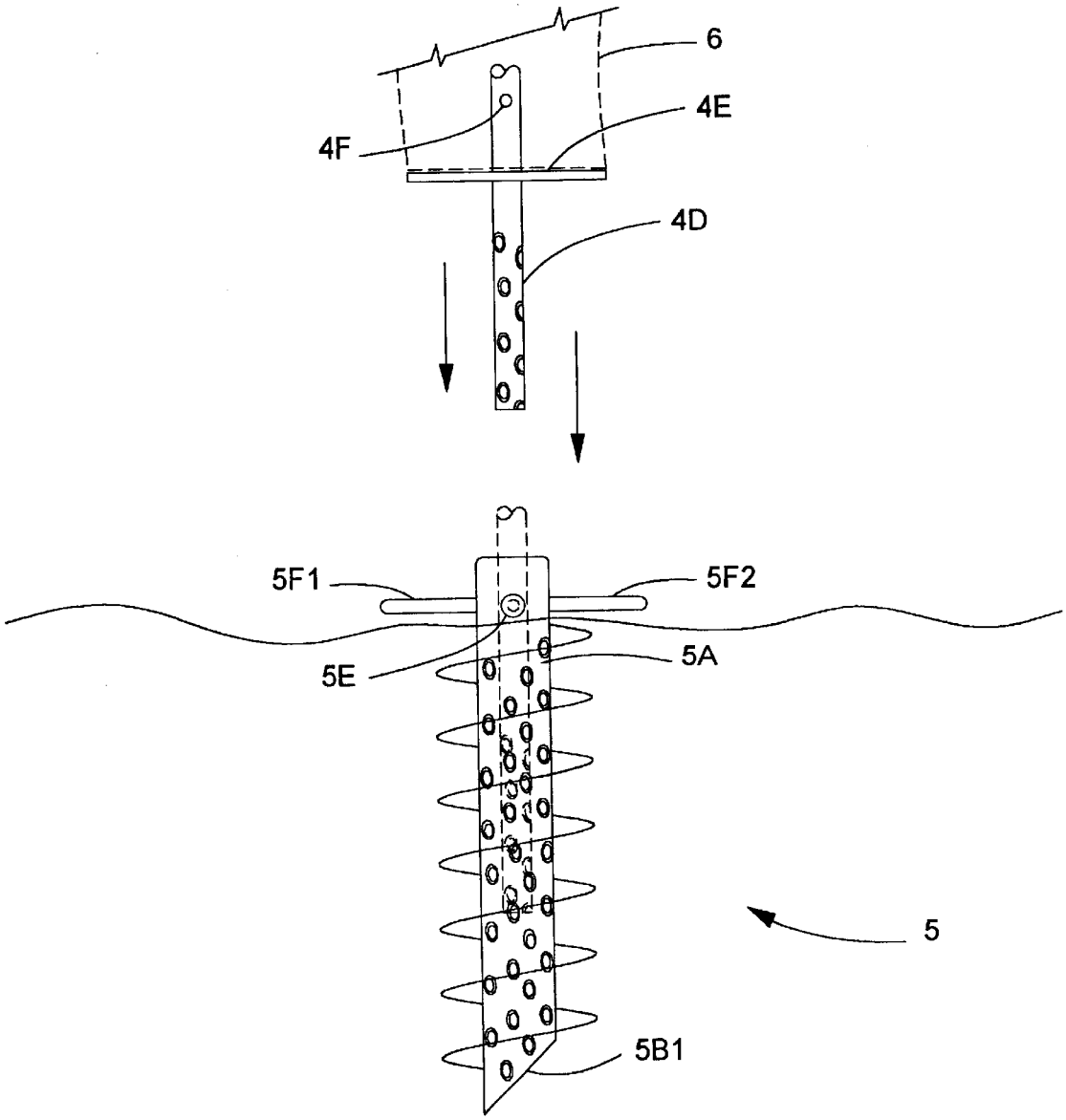
FIG. 2B1

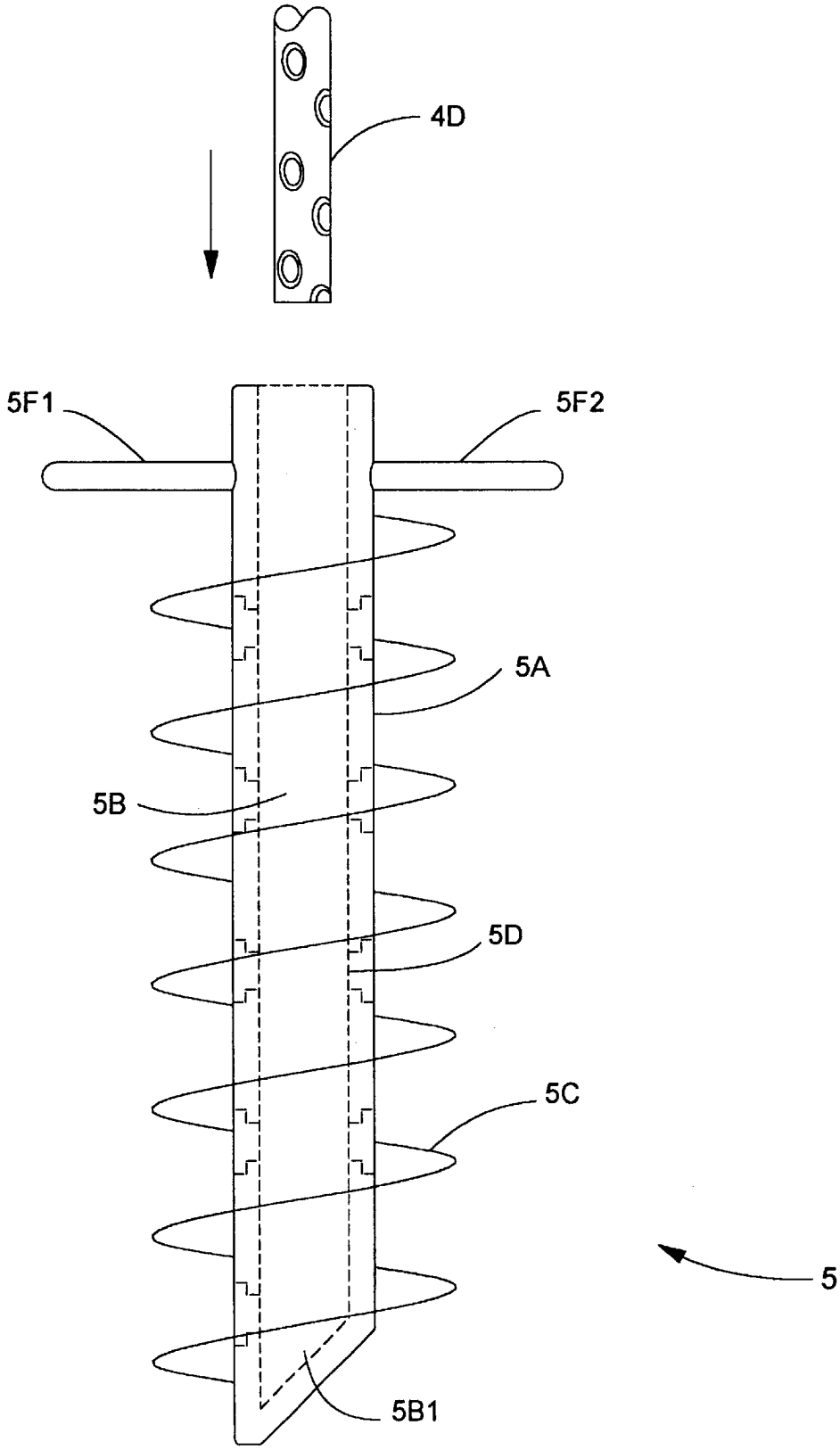
FIG. 2B2

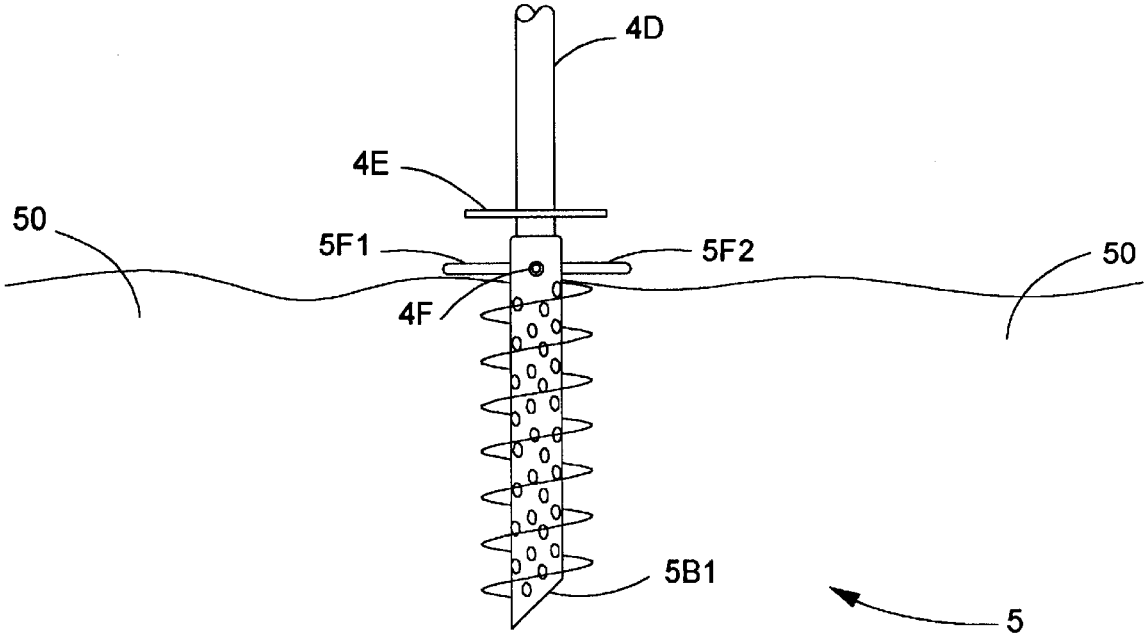
FIG. 2B3

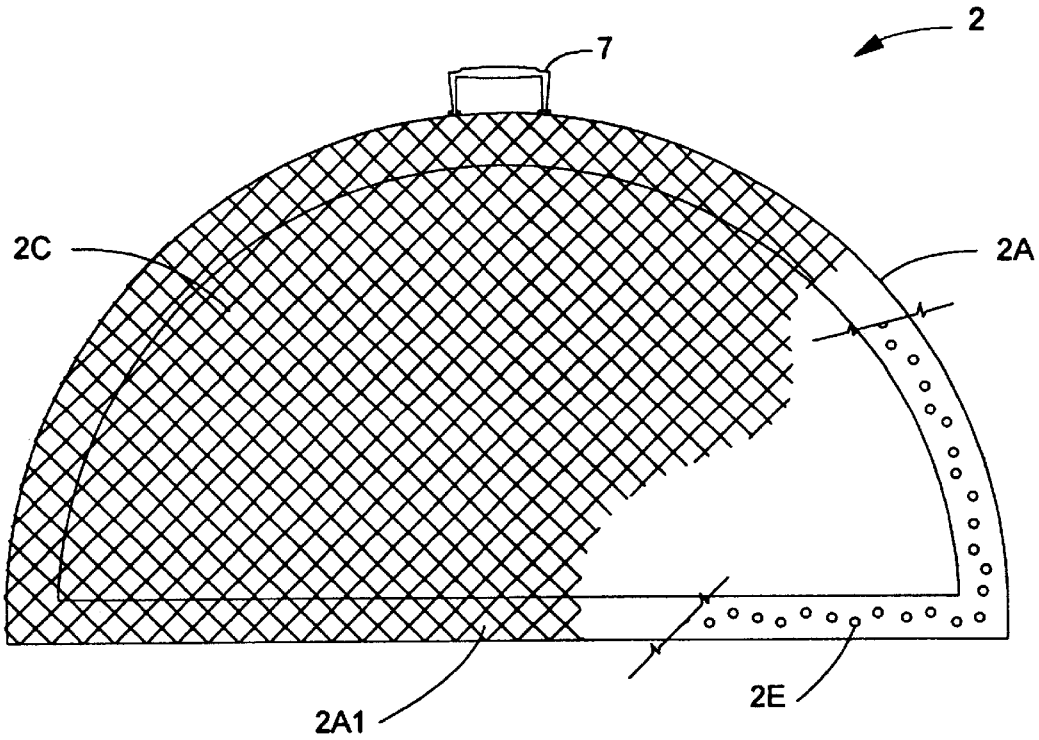
FIG. 2C1
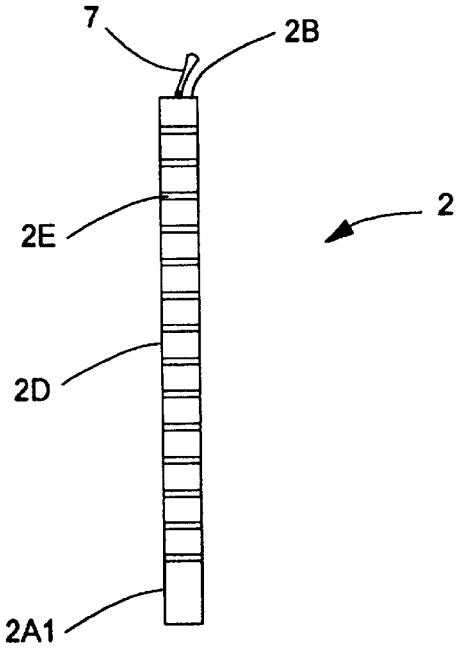
FIG. 2C2

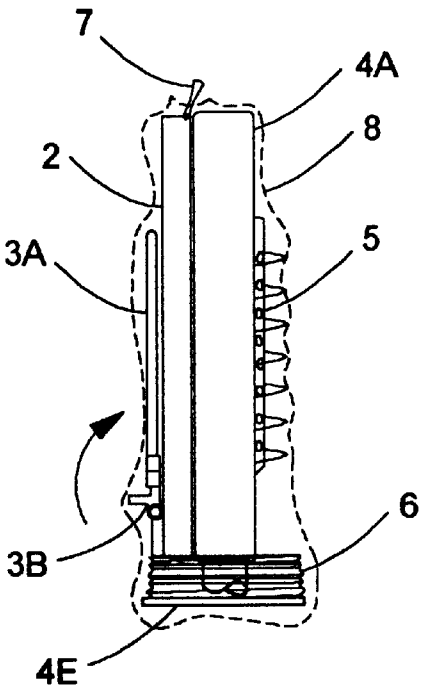
FIG. 2E2
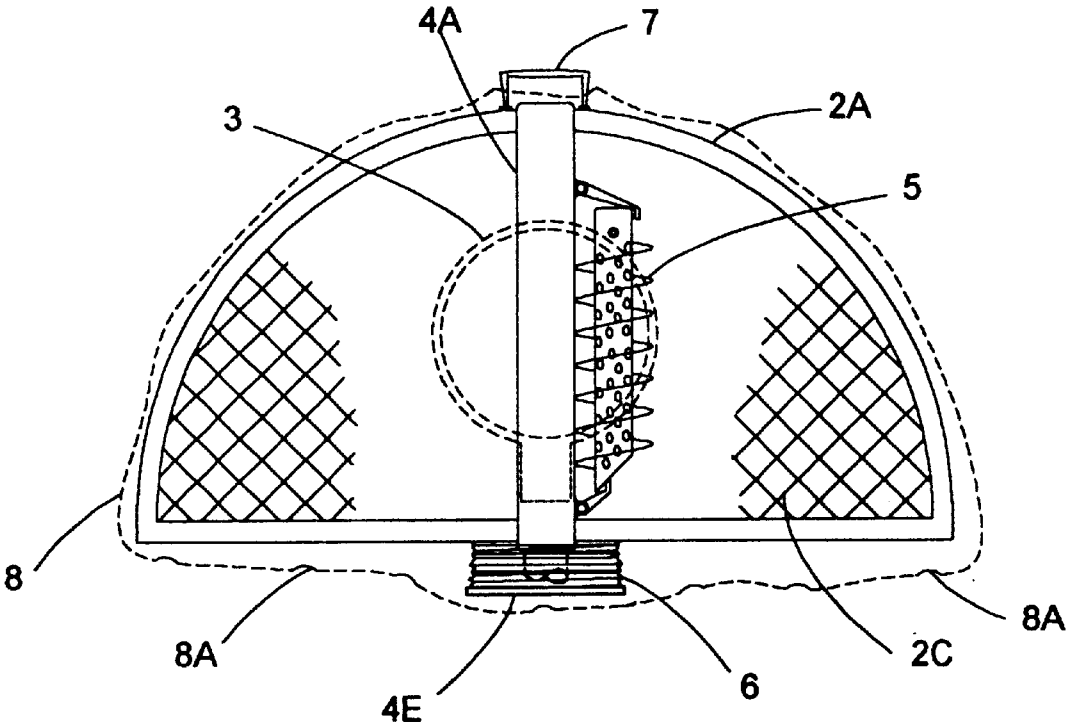
FIG. 2E1

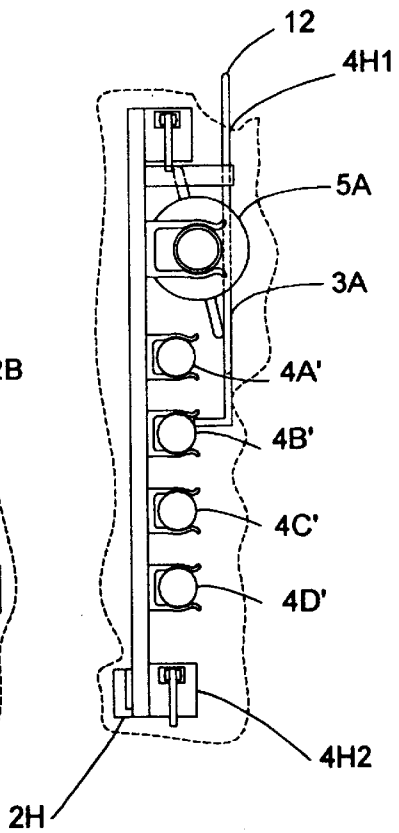
FIG. 3D2
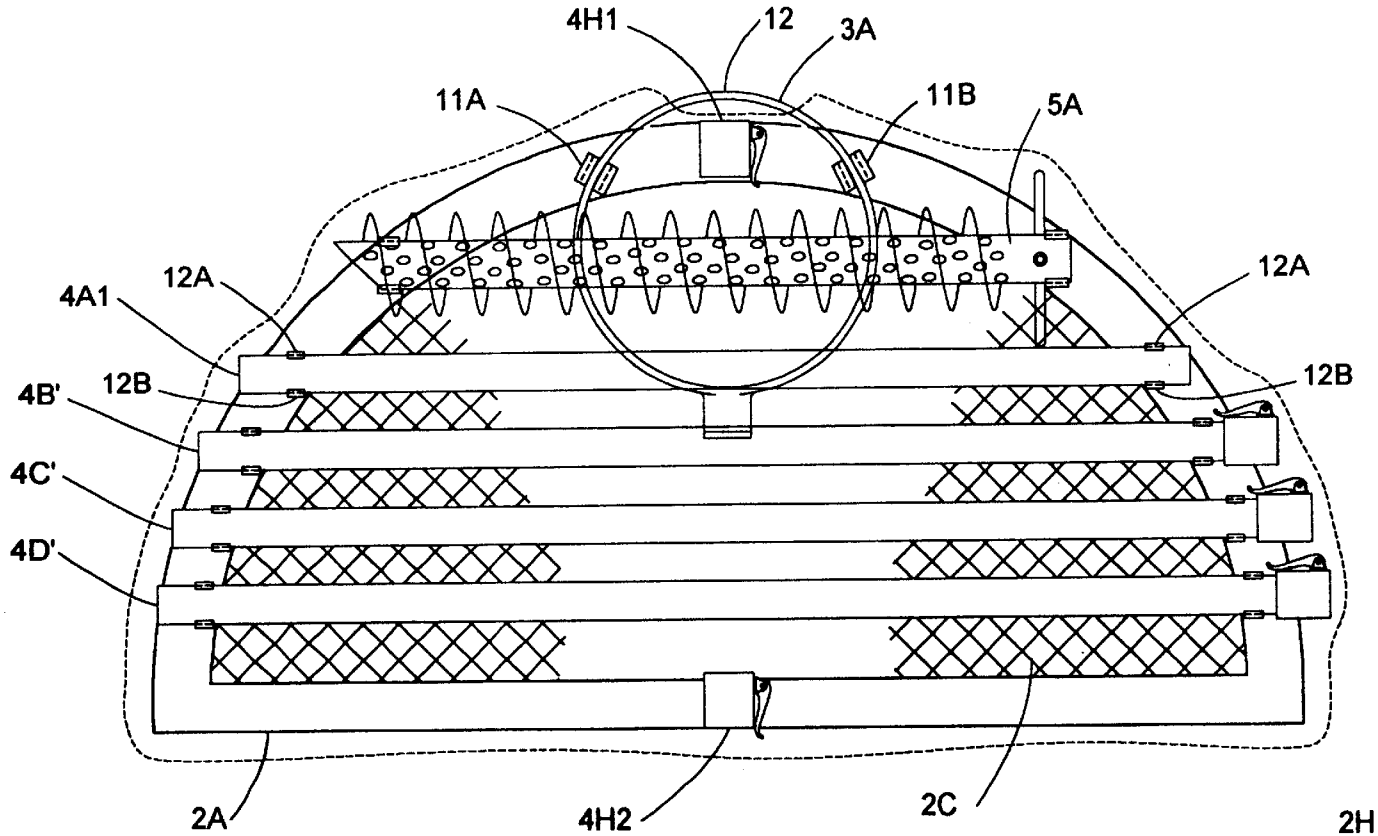
FIG. 3D1

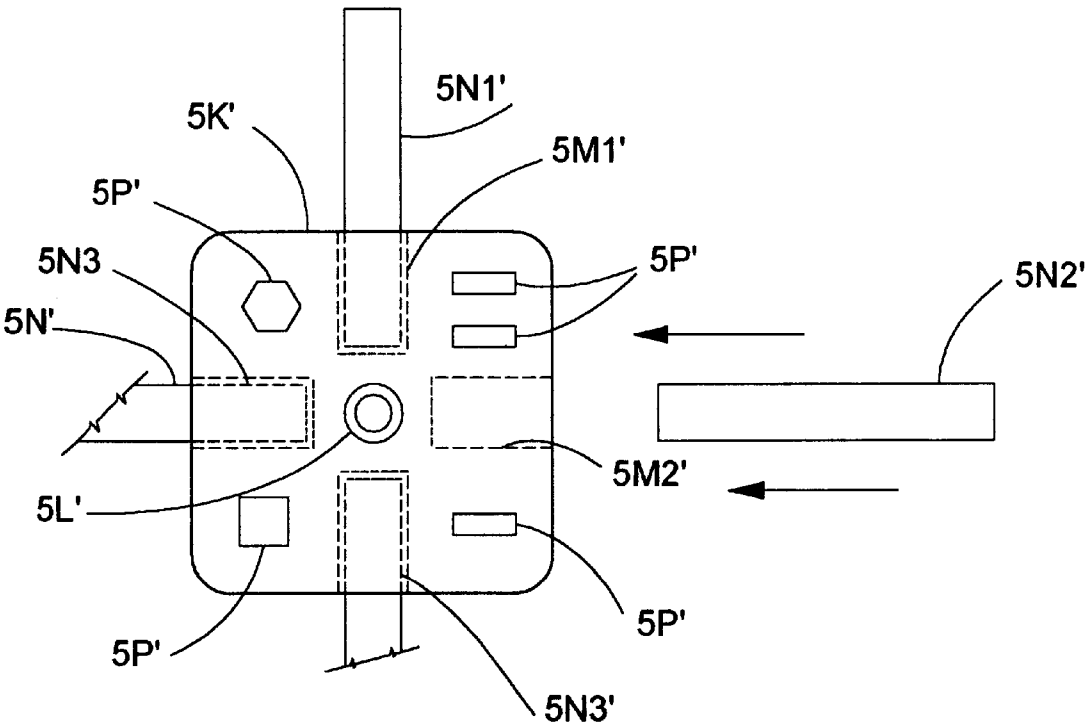
FIG. 4A1
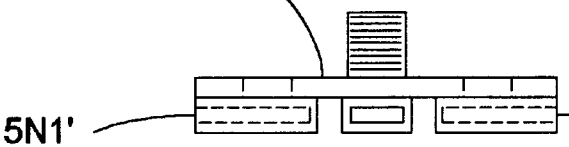
FIG. 4A2

TRANSPORTABLE BASKETBALL SYSTEM HAVING WIND-TRANSMISSIVE MESH BACKBOARD STRUCTURE AND SAND-ANCHORABLE POST ASSEMBLY

CROSS-REFERENCE TO RELATED U.S. APPLICATIONS

This Application is a Continuation of application Ser. No. 09/535,837 filed Mar. 28, 2000 now U.S. Pat. No. 6,575,853, and incorporation herein by reference as if fully set forth herein.

BACKGROUND OF INVENTION

1. Field of Invention

The present invention relates to a novel transportable basketball system for enabling the safe playing of basketball-related games on beaches, shorelines and other sand covered outdoor environments where the forces of wind and turbulent airstreams can be strong and unpredictable.

2. Brief Description of the Invention

Annually, millions of people, both young and old, travel to beaches, lakes and shorelines to enjoy the sand, surf and sun. To pas the time and have fun, these beach goers toss Frisbee® discs and balls, and play various types of games including volleyball, badminton, and horseshoes. About a decade and a half ago, a modified version of basketball, called "beach basketball" was invented by Philip Bryant on the physical education fields of Gulf Shores School. This game is played on a circular court formed on the beach, and uses a hoop goal without a backboard structure, enabling a basketball to be passed through the hoop from any direction on the circular court. In accordance with game regulations published on the World Beach Basketball® WWW site at http://www.beachbasketball.com, there are no out of bounds conditions, and no time clocks, thus providing for non-stop action and play. Ball movement is carried out by passing or taking 2½ steps and then passing the ball. Dribbling the ball is not allowed.

While the game of beach basketball described above has evolved from a tremendously effective skill improvement game, to a very popular, widespread competitive beach sport, it nevertheless suffers from a number of shortcomings and drawbacks.

In particular, it involves equipment which is bulky and difficult to install in the sand. In particular, the associated pole structure requires permanent or semi-permanent installation involving the excavation of deep holes of at least 3–4 feet deep, and possibly the adding of a cementous mixture to secure the pole structure with the ground in order to safely support the hoop structure of this prior art basketball system. Consequently, this prior art design basketball system design is not suitable for simple and convenient installation and use by parents and grandparents supervising several young children who want to play a basketball-related game on the beach for an afternoon, and thereafter want to dissemble and transport the system back home with the ease of installing and using a beach umbrella.

Moreover, this prior art basketball system does not have a backboard structure for making bank-type shots, and visually-tracking the location of the hoop structure through which players seek to pass a ball during game play.

Efforts to add a conventional backboard structure to prior art beach basketball systems, as described above, will require even more massive basketball pole subsystems, and pole anchoring measures, to support the weight of the backboard structure against gravitational forces, and prevent the resulting structure from being blown down by forceful air currents and sand streams produced by gusts of winds typically expected along beaches, oceanfronts, lakes and shorelines. Such resulting structures will necessarily require careful planning in designated areas and involve permanent installation methods practiced only by highly trained recreational engineers and construction workers.

Thus, there is a great need in the art for an improved way of and means for enabling parents, grandparents and others to safely play basketball-related games on beaches, oceanfronts, lake-fronts, shorelines and other sand covered outdoor environments, while avoiding the shortcomings and drawbacks of prior art systems and methodologies.

OBJECTS AND SUMMARY OF THE PRESENT INVENTION

Accordingly, it is a primary object of the present invention is to provide an improved method of and system for safely playing basketball-related games on beaches, shorelines and other sand-covered outdoor environments, while avoiding the shortcomings and drawbacks of prior art systems and methodologies.

Another object of the present invention is to provide such a novel transportable basketball system which employs a wind-transmissive backboard structure that is light-weight and presents little resistance to wind and air currents produced on beaches, shorelines and other sand-covered outdoor environments, and a sand-based pole anchoring assembly that is provided to securely support the pole assembly firmly within the soil, so that basketball-related games can be played safely even in windy environments.

Another object of the present invention is to provide such a transportable wind-transmissive basketball system, wherein the wind-transmissive backboard structure is realized by a lightweight framework defining the perimeter of the backboard and an open-cell type mesh material having a coarse weave which is stretched between the frame borders to provide a substantially planar wind-transmissive backboard surface, against which a light-weight basket ball will deflect during basketball play.

Another object of the present invention is to provide such a transportable wind-transmissive basketball system, wherein the pole assembly is formed by interlocking a plurality of pole sections together, and once assembled, the pole structure is inserted within clamping structures provided on the rear of the backboard structure and thereafter securely clamped onto the pole assembly.

Another object of the present invention is to provide such a transportable wind-transmissive basketball system, wherein the sand-based pole anchoring assembly of the present invention exploits principles of soil-mechanics to securely anchor the pole assembly with a bed of water-saturated sand and to enable the safe playing of basketball on windy beaches without the risk of wind lifting the basketball system out of the sand and rendering it airborne.

Another object of the present invention is to provide such a transportable wind-transmissive basketball system, wherein the sand-based pole anchoring assembly includes a pole anchoring sleeve with a hollow inner volume and screw threads for manually driving the sleeve into a bed of sand by manual rotation of the sleeve.

Another object of the present invention is to provide such a transportable wind-transmissive basketball system, wherein the pole anchoring sleeve also has perforations formed on the walls thereof to enable grains of sand outside the sleeve to pass therethrough, and set up with grains of sand when saturated with water during the pole installation process.

Another object of the present invention is to provide such a transportable basketball system, wherein the sand-based pole anchoring assembly includes a pole anchoring plate having perforations which allow grains of dry sand to flow therethrough, and set up with surrounding grains of sand when the buried pole anchoring plate is buried beneath a bed of dry sand during the pole installation process.

Another object of the present invention is to provide such a novel transportable wind-transmissive basketball system, wherein the height of the basketball hoop structure can be adjusted from about 5 to about 8 or more feet above the sand surface.

Another object of the present invention is to provide such a novel transportable wind-transmissive basketball system, wherein the total weight of the system, when disassembled and configured into its transport configuration, is less than about 15 pounds.

Another object of the present invention is to provide such a novel transportable basketball system, wherein the backboard structure, basketball hoop and pole components of the system are made from a plastic or other lightweight non-conductive material which does not conduct electricity or support intensity electric field intensities, thereby reducing the likelihood of attracting lightening bolts during sudden lightening storms along a beach or shoreline.

Another object of the present invention is to provide such a novel transportable wind-transmissive basketball system, which can be used to play basketball related games on the beach or in shallow water, typically without dribbling the ball.

Another object of the present invention is to provide a novel transportable wind-transmissive basketball system, which can be disassembled and reconfigured into an ultra-compact lightweight assembly that can be easily carried from the home, into the car and from the car onto the beach or lakefront for assembly and installation with minimal effort, no greater than installing a beach umbrella.

Another object of the present invention is to provide such a transportable wind-transmissive basketball system having a transportable weight of less than 15 pounds and can be easily assembled put together in less than five minutes.

Another object of the present invention is to provide such a transportable basketball system, wherein the wind-transmissive backboard structure is connectable to the telescoping pole assembly, having an integrated inflatable pole cushioning sleeve.

Another object of the present invention is to provide a novel transportable wind-transmissive basketball system, wherein a flexible foundation coupling is used to couple a pole anchoring plate buried deep within a bed of sand, thus enabling the pole assembly supporting the backboard structure to undergo a degree of movement in the event that a person runs into the same.

Another object of the present invention is to provide a novel transportable wind-transmissive basketball system, wherein each part in the system is either color-coded or numbered and snap-fittable into correspondingly color-coded or numbered storage locations strategically arranged on the backboard structure, thereby providing an ultra-compact device for transportation and storage, while minimizing the risk of loss of subcomponents during assembly and disassembly operations.

Another object of the present invention is to provide such a transportable basketball system, wherein the assembled system in its transport configuration can be placed within a plastic carrying case having small holes on the bottom thereof so that the configured system can be easily washed to eliminate the buildup of sand in the carrying bag.

Another object of the present invention is to provide such a transportable basketball system, wherein the pole sections used to construct the pole assembly are made from fiber-reinforced polymer tubing in which a low specific gravity foam is injected to provide buoyancy properties to the tube sections in the event the pole sections are put in or used in the water sport environments.

Another object of the present invention is to provide a novel ball construction for use with the novel transportable basketball system of the present invention, wherein the ball has approximately 8–10" in diameter, and comprises a pair of semi-spherical half sections which can be combined into a spherical ball using Velcro brand fastening material to enable the ball to be disassembled, attached to and transported with the basketball system alone or in a plastic carrying case.

Another object of the present invention is to provide a novel ball construction for use with the novel transportable basketball system of the present invention, wherein the ball has approximately a 8–12" in diameter, and comprises a lightweight solid foam core coated with a thick sponge material that provides the proper weight, balance and grip qualities for shooting at the basket.

These and other objects of the present invention will become apparent hereinafter.

In general, the above identified objects of the present invention are realized within a transportable basketball system having components which are arrangeable in a play configuration during which a basketball-related game can be played, and also in a transport configuration during which said transportable basketball system can be easily transported between a sand covered outdoor environment and a remote location. Preferably, the transportable basketball system comprises a wind-transmissive backboard structure having a backboard surface disposed substantially within a first plane, bounded by a frame structure, and characterized by high degree of air permeability across said backboard surface so that air currents, expected on said covered environment, can pass therethrough with minimal resistance yet deflect a lightweight basketball when tossed thereagainst during basketball-related games. A basketball hoop structure, defining an opening through which a basketball can be passed during basketball-related games, is operably connected to the wind-transmissive backboard structure. The basketball hoop structure is generally disposed within a second plane substantially perpendicular to the first plane when the transportable basketball system is arranged in its play configuration. A pole assembly, including a plurality of arrangeable pole sections, is provided for supporting the wind-transmissive backboard structure at a height above the surface of a sand bed located in the sand covered outdoor environment. A pole anchoring device, driveable beneath the sand bed, is also provided for supporting the pole assembly in a substantially plumb orientation during the play configuration.

When the basketball system is arranged in its play configuration, the basketball hoop structure is operably connected to the wind-transmissive backboard structure and the second plane is substantially perpendicular to said first plane, the pole assembly is operably connected to the wind-transmissive backboard structure and the pole anchoring device, and the pole anchoring device is driven beneath said sand bed and supports the pole assembly in a substantially plumb orientation while the wind-transmissive backboard structure is supported at a height above the surface of the sand bed, and When the basketball system is arranged in its transport configuration, the second plane of the basketball hoop structure is orientable substantially parallel to the first backboard surface and the pole sections of the pole assembly are orientable in one or more planes substantially parallel to the first plane and within a space generally defined by dimensions of the frame structure, whereby the transportable basketball system can be arranged for transport in a compact package.

In one illustrative embodiment, the wind-transmissive backboard structure comprises a frame structure having a perimetrical border defining said boundaries of the backboard surface. Open-cell type mesh material is stretched tightly about and fastened to the frame structure so as to form a planar backboard surface which presents minimal resistance to expected air currents present in the sand covered outdoor environment, and undergoes resilient surface distortion when a lightweight basketball is bounced off the backboard surface during game-related play.

In another illustrative embodiment of the present invention, the wind-transmissive backboard structure comprises a solid substrate of substantially planar geometry, and a plurality of fine air-transmission apertures formed over the surface of the solid substrate.

In one illustrative embodiment, the pole assembly comprises a plurality of telescopically-connected tubes which are intercoupled using telescopic linking mechanisms. The plurality of telescopically-connected tubes comprises a pole encasing tube of largest diameter affixed to the rear side of the backboard frame, and a plurality of telescopically-connected pole sections of narrower diameter are enclosable within the pole encasing tube during the transport configuration. In this particular embodiment of the present invention, either one, two or all of the telescopically-connected pole sections can be pulled out from the pole encasing tube and can be locked into position to support the wind-transmissive backboard structure at a height above the sand bed. An inflatable pole-cushioning sleeve can be provided for surrounding a substantial portion of the pole assembly when the transportable basketball system is arranged in its play configuration. In such an illustrative embodiment, the innermost telescopically-connected pole section comprises a disc-like flange located from the end thereof, for delimiting the movement of the inflatable pole cushioning sleeve off the innermost telescopically-connected pole section. When the inflatable pole-cushioning sleeve is deflated, and the pole assembly is completely retracted within the pole encasing tube, the deflated cushioning sleeve is delimited by the disc-like flange.

Preferably, the basketball hoop structure is hingedly connected to the frame structure so that, when the transportable basketball system is arranged in its play configuration, the first plane is substantially perpendicular to the second plane, and when the transportable basketball system is arranged in its transport configuration, the first plane is substantially parallel to the second plane.

In this illustrative embodiment, the pole anchoring device comprises a pole anchoring sleeve having a hollow inner volume for receipt of a portion of the pole assembly. A plurality of perforations is formed through the pole anchoring sleeve, permitting the passage of grains of sand into the hollow inner volume when the pole anchoring sleeve is driven beneath the sand bed. A set of sand-engaging threads is formed on the external surface of the pole anchoring sleeve; and a set of handle structures is provided on the pole anchoring sleeve, enabling a user to rotate the pole anchoring device while pushing the same into the sand bed, thereby screwing the pole anchoring sleeve beneath the sand bed.

Also, a pole anchoring pin is formed on the innermost telescopically-connected pole section, and the pole anchoring sleeve has an aperture for receiving the pole anchoring pin when the innermost telescopically-connected pole section is inserted within the hollow inner volume of the pole anchoring sleeve, thereby locking the pole assembly to the pole anchoring device.

When arranged in its transport configuration, the compactly configured basketball system of the present invention can be placed in a flexible carrying case for transport.

In an alternative embodiment of the transportable basketball system of the present invention, the pole assembly comprises a plurality of pole sections interconnectable to provide as pole structure to support the wind-transmissive backboard structures above the sand-bed at a desired height. In this embodiment, the pole anchoring device may be realized as a pole anchoring plate having perforations which allow grains of dry sand to flow therethrough, and set up with surrounding grains of sand when the buried pole anchoring plate is buried beneath a bed of dry sand during the pole installation process. When arranged in its transport configuration, the basketball hoop structure, pole sections and pole anchoring device are releasably retained on the rear side of the backboard structure, so that the entire system, and all of its components are assembled into a compact unit for transport.

By virtue of the present invention, the problems associated with prior art beach basketball systems, have been overcome, thus enabling parents, grandparents and others to simply install this basketball apparatus upon a sand covered environment so that basketball-related games can be safely played on beaches, ocean-fronts, lake-fronts, shorelines and other sand covered outdoor environments, and then quickly dissassembled and arranged for transport to remote locations, including the truck of an automobile, while avoiding the shortcomings and drawbacks of prior art systems and methodologies.

Further advantages of the present invention will become apparent hereinafter.

BRIEF DESCRIPTION OF THE DRAWINGS

In order to more fully appreciate the objects of the present invention, the following Detailed Description of the Illustrative Embodiments should be read in conjunction with the accompanying Drawings, wherein:

FIG. 2B1 is a side view of the pole anchoring assembly of FIG. 1, showing the threaded and perforated pole anchoring sleeve driven into the sand using an integrated handle, and the perforated end portion of the backboard pole about to be inserted within the hollow inner volume of the sand-anchoring sleeve;

FIG. 2B2 is a side view of the post anchoring assembly of FIG. 2B1 showing sand passing through the perforations within the sand-anchoring sleeve, for securely supporting the perforated end portion of the backboard pole therewithin;

FIG. 2B3 is a side view of the pole anchoring assembly of FIG. 2B1 showing the end of the backboard pole inserted within the interior volume of the threaded sand-anchoring sleeve, deeply anchored into the sand, and through which the removable handle is passed in order to lock the backboard pole and perforated sleeve securely together and support the backboard pole about the sand surface at a desired adjustable height;

FIG. 2C1 is a perspective view of the wind-transmissive backboard structure employed within the system of FIG. 1 shown removed from its backboard pole assembly and basketball hoop and net structure;

FIG. 2C2 is an elevated side view of the wind-transmissive backboard structure of the first illustrative embodiment of the present invention, with its telescopic pole assembly removed from backboard structure for illustration purposes;

FIG. 2E1 is an elevated rear view of the transportable basketball system of the first illustrative embodiment of the present invention, shown disassembled from the configuration depicted in FIGS. 1 and 2D1 and reassembled into a transport configuration, wherein the hoop structure is folded up against the backboard structure, its telescopic pole assembly is completely retracted within the pole encasing tube affixed to the rear side of the backboard frame, and the threaded pole anchoring sleeve is snap-fitted and releasably retained on the side of the pole-encasing tube, for transport to a remote location (e.g. trunk of an automobile);

FIG. 2E2 is an elevated side view of the transportable basketball system shown in FIG. 2E1 arranged in its transport configuration;

FIG. 3D1 is an elevated rear view of the transportable basketball system of the second illustrative embodiment of the present invention shown in FIG. 3A, shown disassembled from its assembled configuration and reassembled into a transport configuration wherein all of the disassembled components of the system are releasably attached to the rear portion of the backboard structure for transport purposes;

FIG. 2D2 is an elevated side view of the transportable basketball system shown in FIG. 2D1 arranged in its transport configuration;

FIG. 4A1 is a plan view of the subcomponents associated with the pole anchoring assembly of the present invention shown configured with the transportable basketball system of FIG. 4;

FIG. 4A2 is an elevated side view of the subcomponents associated with the post anchoring assembly shown in FIG. 4A1;

DETAILLED DESCRIPTION OF THE ILLUSTRATIVE EMBODIMENTS OF THE PRESENT INVENTION

Figure 1:
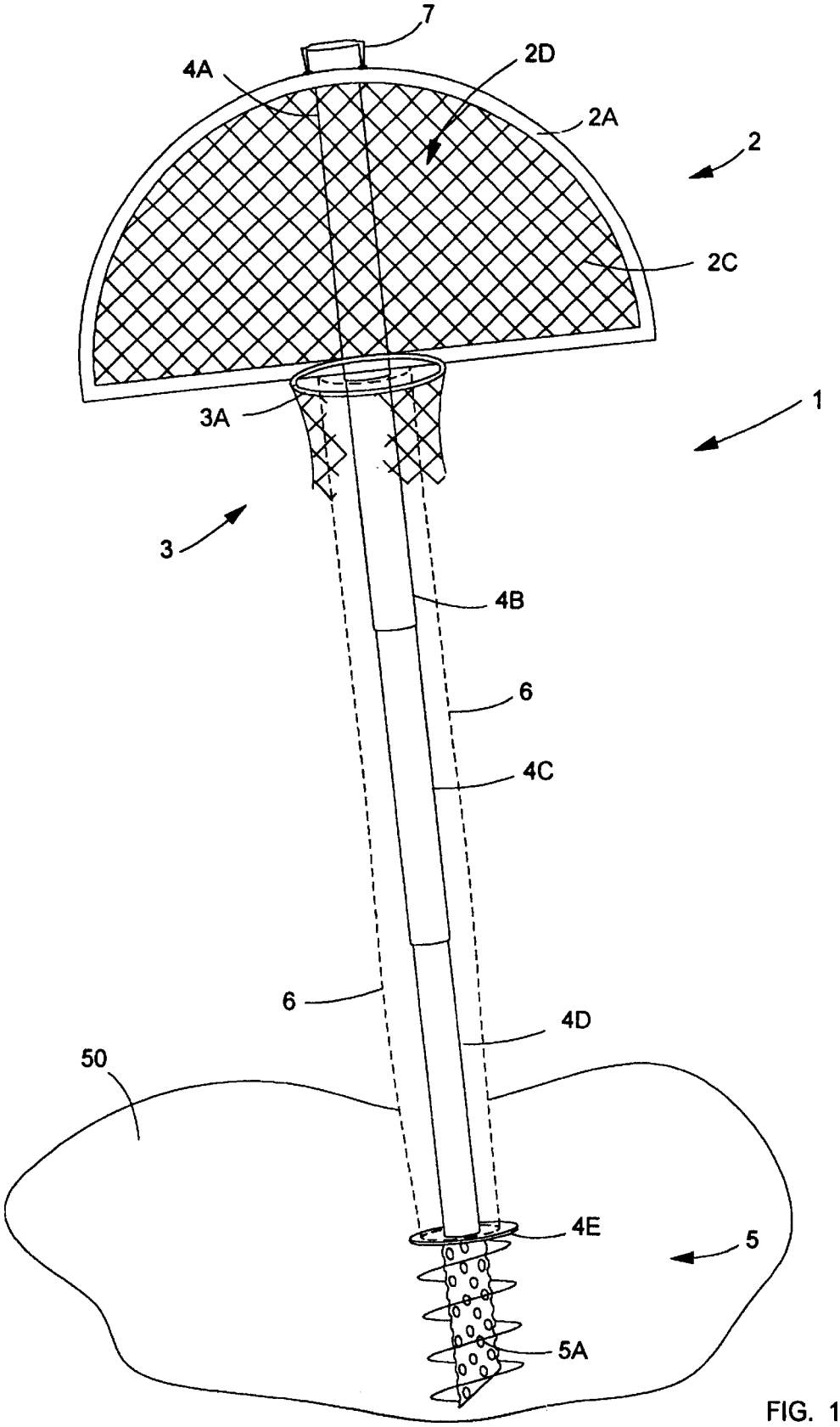
FIG. 1 is a perspective view of the first illustrative embodiment of the transportable basketball system of the present invention, showing a wind-transmissive backboard structure, a basketball hoop and net structure, and a sand-anchorable telescopic-pole assembly configured together so as to enable the safe playing of basketball-related games on beaches, shorelines and other sand-covered outdoor environments.

Referring now to FIGS. 1 through 9, the preferred embodiments of the transportable basketball system of the present invention will be now described in great detail hereinbelow, wherein like elements in the Drawings shall be indicated by like reference numerals.

As shown in FIG. 1, the transportable basketball system of the present invention 1 is shown configured together so as to enable the safe playing of basketball-related games on beaches, shorelines and other sand covered outdoor environments. As shown, the transportable basketball system 1 comprises a number of subcomponents, namely: a wind-transmissive backboard structure 2; a basketball hoop and net structure 3; a telescopic pole (i.e. pole) assembly 4; a sand-based pole anchoring assembly 5; and an inflatable pole-cushioning sleeve 6 affixed at one end thereof to the lower portion of the backboard structure 2 and extendable downwardly and about a substantial portion of the pole assembly 4 to provide a layer of air cushioning about the pole for added safety measures to players.

Figures 9, 10, 11:
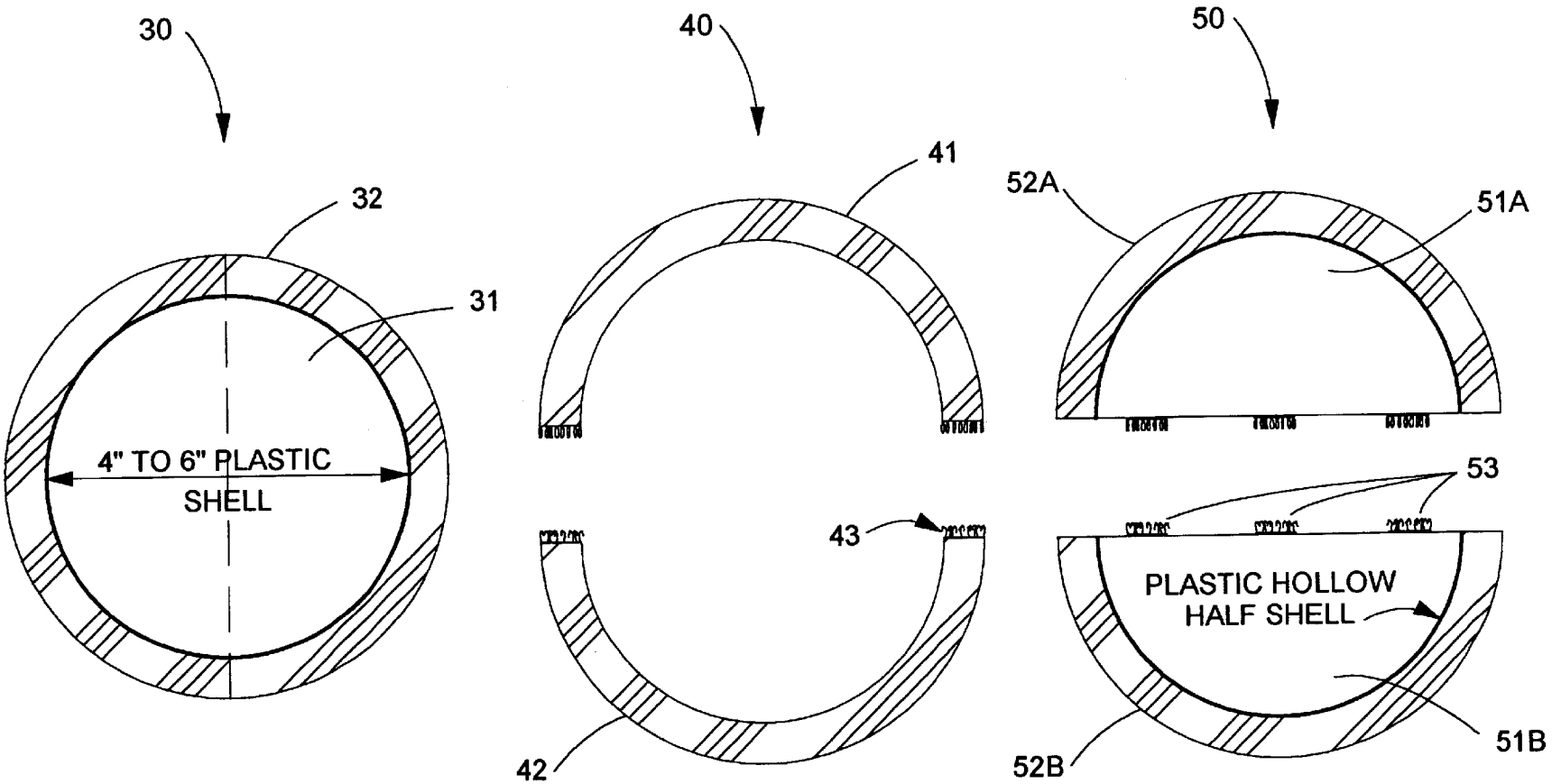
FIG. 9 is a cross-sectional view of a first illustrative embodiment of the basketball construction of the present invention, designed for optimal use with any of the transportable basketball systems of the present invention.
FIG. 10 is a cross-sectional view of a second illustrative embodiment of the basketball construction of the present invention designed for use optimal use with the transportable basketball systems of the present invention.
FIG. 11 is a cross-sectional view of a third illustrative embodiment of the basketball construction of the present invention designed for use optimal use with the transportable basketball systems of the present invention.

In general, the wind-transmissive backboard structure 2 of the present invention has a high degree of air permeability across its surface so that it is it presents low resistance to wind (i.e. air currents) typically expected on beaches, oceanfronts, lakefronts, shorelines and other sand-covered outdoor play environments. This inventive feature can be realized in a light-weight backboard structure in a variety of different ways. Preferably, the wind-transmissive backboard structure of the present invention comprises: a lightweight frame structure 2A having a perimetrical border 2B defining top, bottom and side regions, as well as a central top and bottom regions; and an open-cell type mesh or screen material 2C stretched tightly over the frame structure 2A, and affixed thereto by staples, glue, ultra-sonic welding or other fastening means, so as to form a planar backboard surface 2D which (i) presents minimal resistance to expected air currents present on the beach or along a shoreline, and (ii) undergoes minimal surface distortion when a lightweight basketball, as disclosed for example in FIGS. 7 through 9, is bounced off the backboard surface during game-related play. In some embodiments of the present invention, the open-cell screen material may be made from plastic mesh material integrated with the perimetrical border 2B of the backboard structure. The open cells of the plastic screen material should have dimensions which provide sufficient structure support for the underlying backboard surface, but provide minimal resistance to air current flow along a beach or ocean shore, thereby greatly reducing wind-related loading against the structure.

Alternatively, the wind-transmissive backboard structure of the present invention can be realized by forming fine slots, holes, or perforations through a solid substrate material made of low-density foam plastic, wood, fiberglass, metal and/or composite material. Such slots, holes or perforations in the backboard substrate can be arranged in any pattern and in accordance with any spatial periodicity that allows for a high degree of air transmission through the resulting backboard surface with minimal resistance.

Figure 2A:
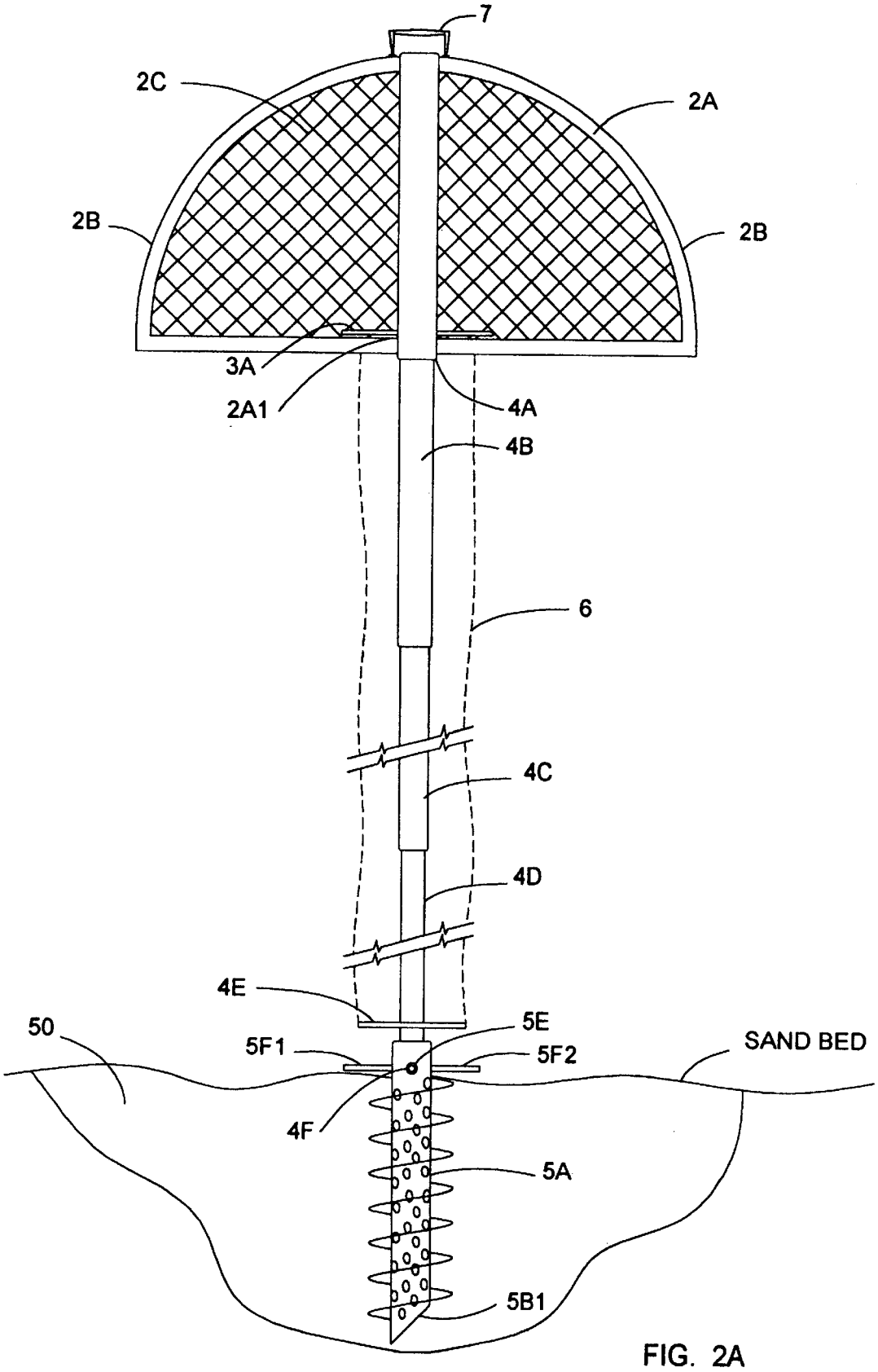
FIG. 2A is a rear view of the transportable basketball system of FIG. 1 showing its telescopic-pole anchoring assembly in relation to a sandy shoreline in which the basketball system is installed.

As shown in FIG. 2A, the pole assembly 4 of the illustrative embodiment comprises a set of telescopic tubes 4A through 4C which are intercoupled using conventional telescopic linking mechanisms known in the pole art. In the illustrative embodiment, pole encasing tube 4A of largest diameter is permanently affixed to the rear surface of the backboard frame 2A, as shown in FIG. 2A. In the illustrative embodiment, this pole structure is approximately 36 inches high, the maximum height of the backboard structure 2 of the illustrative embodiment, but may be shorter or longer in other applications. Also, as shown in FIG. 2C1, such holes or apertures 2E may also be formed in the frame portion of the backboard structure to reduce the mass thereof and increase the wind-transparency of the backboard structure. Three 36 inch telescopically-connected pole sections 4B through 4D are enclosable within the pole encasing tube 4B during the transport mode of the system, shown in FIGS. 2E1 and 2E2. Depending on the hoop height requirements of the players using the basketball system, either one, two or all three of the telescopically-connected pole sections can be pulled out from the pole encasing tube 4A and locked into position to provide a backboard having a pole height of either about two, five or eight feet, respectively. Using more advanced pole launching mechanisms, a broader range of backboard height adjustments can be made possible.

As shown in FIG. 2B1, the lowermost/innermost telescoping pole section 4D comprises several notable features, namely: a disc-like flange 4E located about 14 inches from the end of the pole lowermost/innermost section 4D; and a spring-biased pole-locking pin 4F located at about 12 inches from the end of the lowermost/innermost telescoping pole section 4D.

As best shown in FIG. 2E1, the function of the disc-like flange 4E is to delimit the excursion of the inflatable pole cushioning sleeve 6 when the cushioning sleeve is deflated, the pole assembly is completely retracted within the pole encasing tube 4A, and the remaining system components are arranged so that the system is in its transport configuration, as shown in FIG. 2E1. With one end of the inflatable cushioning sleeve affixed to the lower end of the backboard structure 2, and the free end thereof delimited by the disc-like flange. the cushioning sleeve is free to adjust and cushion the pole assembly regardless of the overall length to which it is adjusted in any particular application.

Figure 3A:
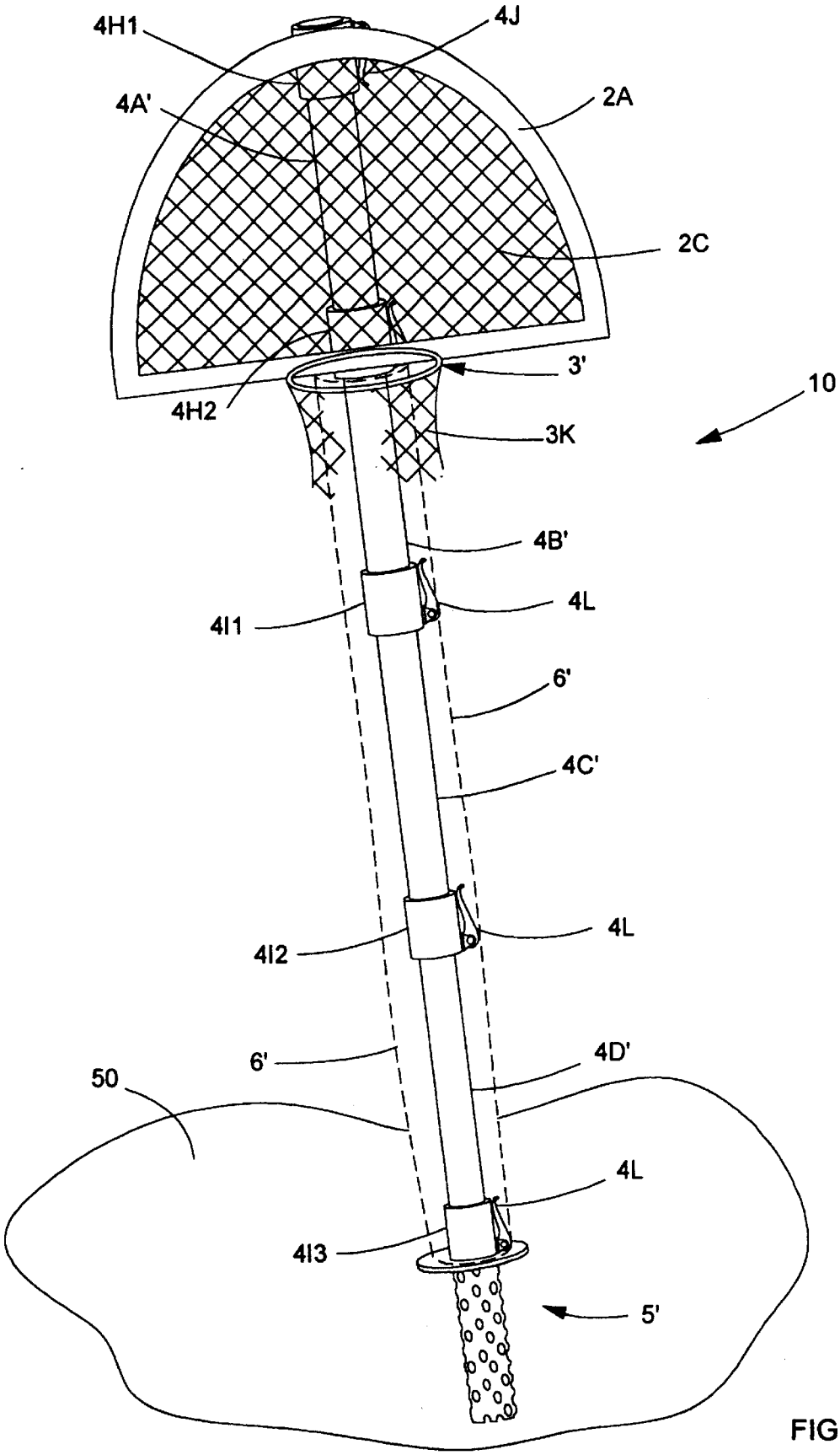
FIG. 3A is a perspective view of the second illustrative embodiment of the transportable basketball system of the present invention, showing a wind-transmissive backboard structure, a basketball hoop and net structure, and a sand-anchorable pole assembly comprising discrete pole sections that are arrangeable into a play configuration for enabling the safe playing of basketball-related games on beaches, shorelines and other sand-covered outdoor environments.
Figure 3B:
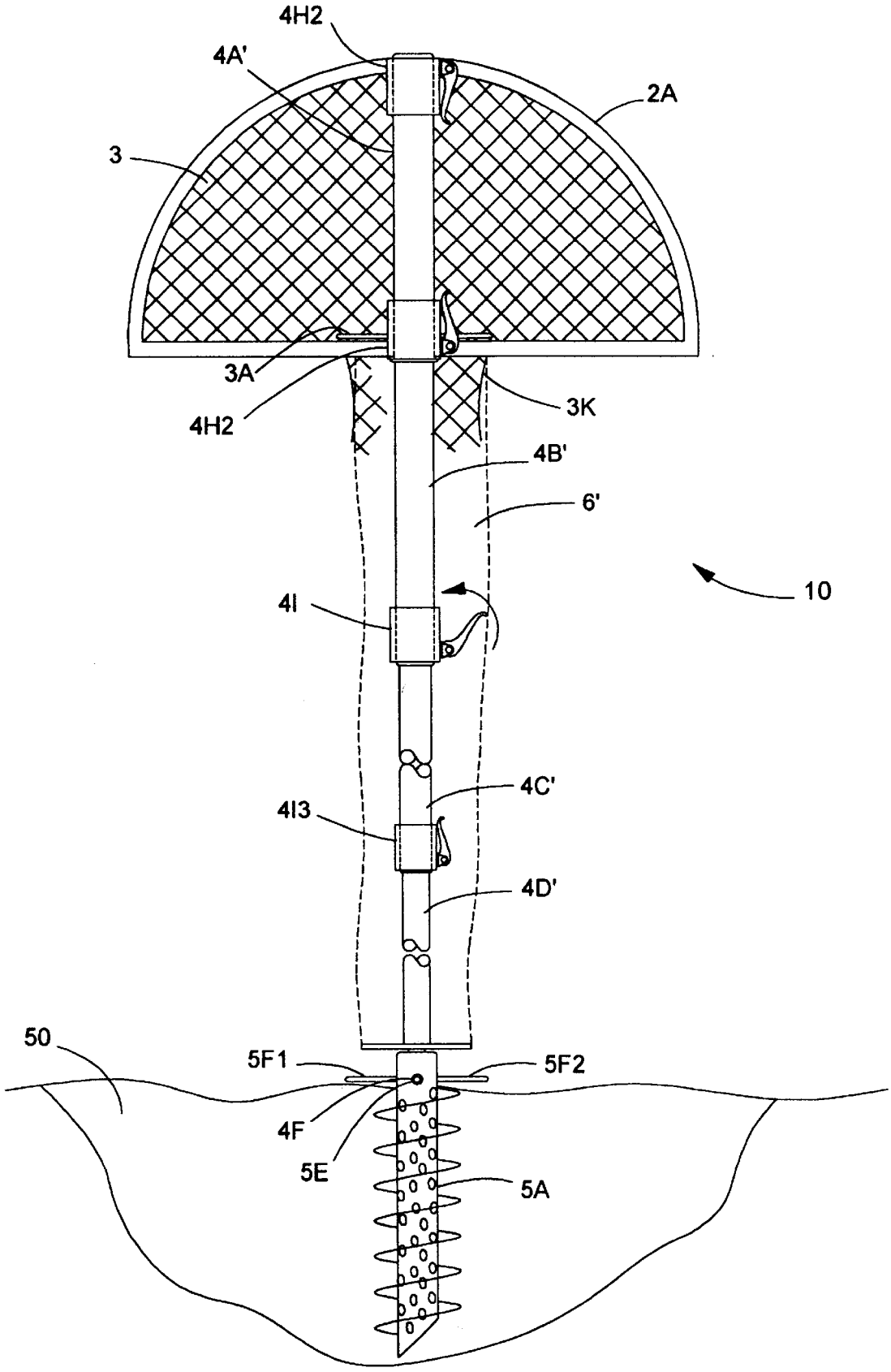
FIG. 3B is a rear view of the second illustrative embodiment of the transportable basketball system shown in FIG. 3A.

As shown in FIG. 2B3, the function of pole-locking pin 4F is to snap into a corresponding pole locking aperture 5E formed in the pole anchoring sleeve 5A when the lowermost pole section 4D is pushed into the hollow core of the sleeve and the pin 4F and aperture 5E register with each other. As such, the pole anchoring sleeve 5A will receive about 12 inches of the inner-most/lowermost pole section 4D, while the pole anchoring sleeve 5A will be screwed into the sand surface to a depth of about 15 to about 21 inches or so, depending on the loading requirements of the backboard structure. In general, each pole section 4B through 4D can be made of a strong lightweight material such as metal, plastic, fiberglass, fiber reinforced polymer, or composite material. Preferably, the backboard 2B is made from low density foam or other lightweight plastic material to provide desired buoyancy properties thereto so that the basketball system will float on water, in the event that it is introduced thereinto, for whatever reason.

Figure 2D:
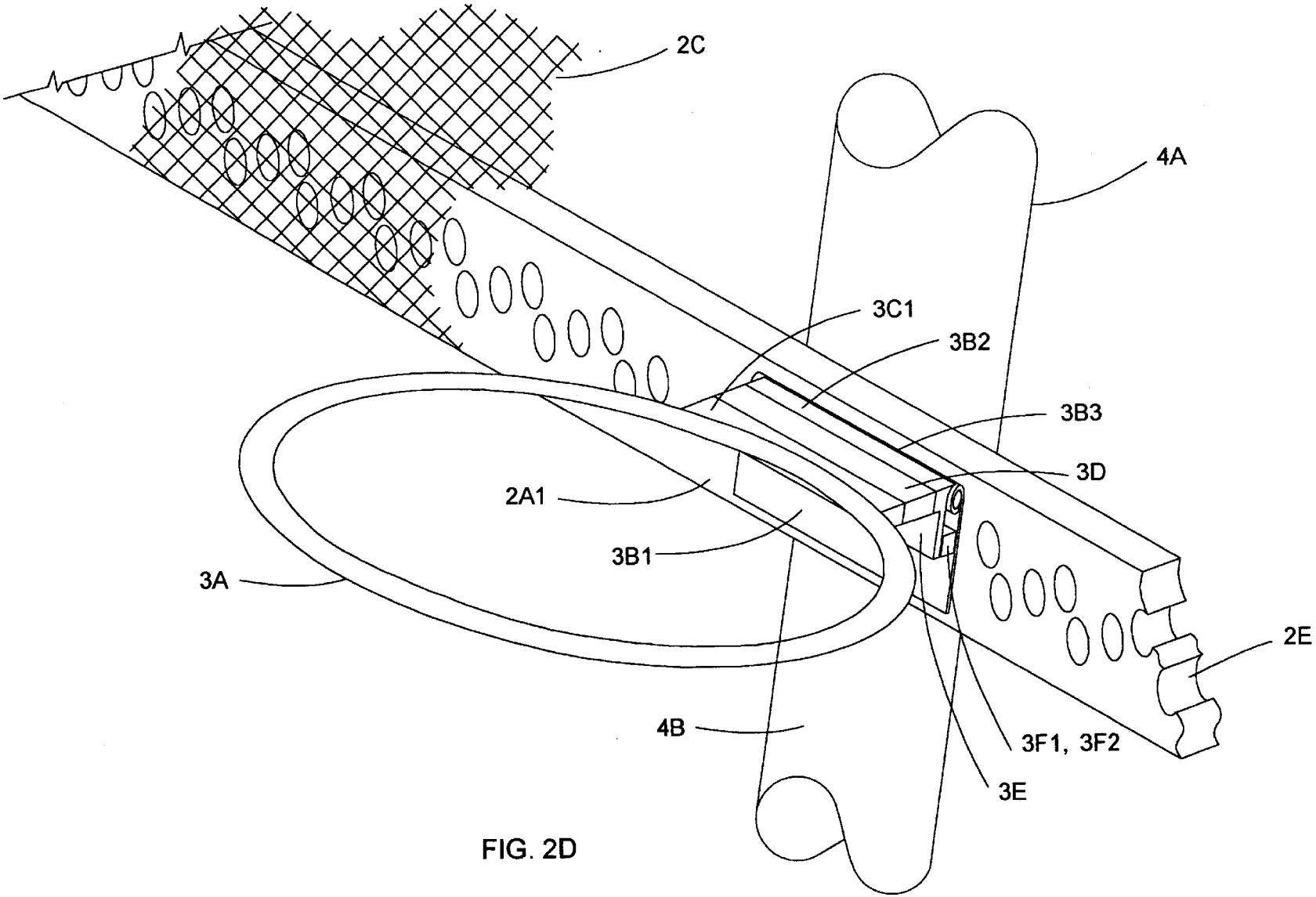
FIG. 2D is a perspective, partially cut-away view of the wind-transmissive backboard structure of FIG. 1, showing the basketball hoop structure hingedly connected to the frame portion of the backboard structure so as to enable the hoop structure to be folded up and back against the backboard during transport operations.

As shown in FIGS. 2A through 2B3, the sand-based pole anchoring assembly 5 of the illustrative embodiment comprises: (1) a post-anchoring sleeve 5A (e.g. of about 15 to 21 inches in length) having (i) a hollow center volume 5B, (ii) an open-end portion 5B1 permitting sand to pass up into the hollow center volume, (iii) a set of sand-engaging threads 5C spirally extending about the outer surface of the sleeve 5A, (iv) a plurality of perforations 5D formed through the wall surface thereof 5A to permit sand to flow about the entire structure once it is plunged beneath the sand surface, and (v) a pole-locking aperture 5E formed in the upper edge of the anchoring sleeve 5A for receiving the spring-biased pole-locking pin 4F provided on the lowermost telescoping pole section 40; and (2) a pair of handle structures 5F1 and 5F2 extending radially outward from the top portion of the pole anchoring sleeve so as to form a hand-operable tool, grippable by a pair of human hands, for screwing the post-anchorable sleeve 5A deep beneath a bed of sand 50. Preferably, the cross-sectional dimensions of the hollow center volume 5B of the sleeve are slightly greater than the outer dimensions of the lowermost pole section 4D so that the pole section 4D can be pushed easily into the hollow center volume 5B once driven deep beneath the surface of the sand. As shown in FIG. 2D, the basketball hoop and net structure 3 of the first illustrative embodiment are hingedly connected to the lower central portion of the backboard frame 2A so that it can be lowered down into its play position shown in FIGS. 1 and 2D, or folded back up against the backboard surface 2D during its transport configuration shown in FIGS. 2E1 and 2E2.

As shown in FIG. 2D, the basketball hoop structure 3 of the first illustrative embodiment comprises: a circular-type hoop (i.e. rim) structure 2A; a hinge mechanism 3B having a first hinge portion 3B1 secured to the lower central portion of the backboard frame 2A1 by screws or other permanent fastening devices, and a second hinge portion 3B2 which is free to rotate about the hinge axle 3B3 of the hinge mechanism; a first support plate 3C1 integrally connected to a portion of the hoop structure 3A and a resilient structure 3D which is integrally connected to second hinge portion 3B2, so that the plane within which the hoop structure resides is disposed in substantially the same plane as support plates 3C1 and 2B2; and a second support plate 3E integrally connected to the second hinge portion 3B2 and extending perpendicularly thereto. In the play configuration shown in FIG. 2D, the second support plate 3E supports the hoop structure 3A substantially perpendicular to the planar surface of the backboard surface 2D. A pair of releasable clip structures 3F1 and 3F2 disposed on opposite sides of the second portion of the hinge mechanism 3B can be provided to releasably clamp the second support plate 3E down against the first portion 3B1 in the play configuration, requiring a predetermined level of force to rearrange the hoop structure 3A from the play configuration to the transport configuration (e.g. by a relatively gentle tap under the end of the hoop structure).

In FIGS. 2E1 and 2E2, the transportable basketball system of FIGS. 1 through 2D is shown disassembled and arranged into its transport configuration. As shown, the telescopic pole sections 4B through 4D are retracted within the pole encasing tube 4A connected to the rear surface of the backboard frame structure. In this configuration, the hoop structure 3 is also folded up against the front surface of the backboard surface 2D and the pole anchoring sleeve 5A is retained on the side of the pole encasing tube 4A, as shown. A handle 7, provided on the top portion of the backboard frame structure 2A, can be used to transport the configured system to and from the beach or shoreline. Optionally, the configured system shown in FIG. 2E1 can be placed within a flexible carrying case 8 through which the integrated handle 7 projects for handling purposes. If necessary, the bottom portion of the carrying case can be provided with perforations 8A to permit residual sand to escape from the carrying case from the system after it has been washed off with clean water.

Having described the structure and function of the sub-components of the system of the illustrative embodiment shown in FIGS. 1 through 2E2, it appropriate to now describe how to install the system in its play configuration.

Typically, the user will transport the basketball system in its transport configuration to a play site where it is then rearranged for installation. First, the user removes the pole anchoring sleeve 5A from the rear-side of the backboard structure. Then, as shown in FIG. 2B, the pole-anchoring sleeve 5A is screwed into and beneath the sand by manually working the device like a hand tool using a twisting and turning action while applying downwardly directed force, as provided by the weight of the user's body. Typically, there will be no need to drive the sleeve into the sand using sledge hammers or like devices. As shown in FIGS. 2B2 and 2B3, during the sleeve installation process, grains of sand flow freely through the perforations 5D formed in the wall surfaces of the sleeve structure 5A, filling a substantial portion of the hollow interior volume 5B of the sleeve structure 5A. When the pole sleeve has been driven beneath a bed of sand, the innermost/lowermost pole section 4D is driven into the sand filled interior volume 5B of the sleeve to about 12 inches in depth until the pole locking pin 4F registers with and snaps through the pole locking aperture 5E in the sleeve, thereby locking these components relative to each other and fixing the height of the lowermost/innermost pole section relative to the beach surface. Then, water is poured about the foundation of the pole anchoring sleeve 5A buried beneath the sand, to saturate the sand thereabout and increase the frictional forces between the grains of sand about the sleeve structure in order to greatly increase the stability of the associated pole assembly.

If necessary, the height of the backboard structure 2, relative to the beach surface, can be adjusted by adjusting the telescopic pole sections 4B through 4D. Each pair of adjacent pole sections can be provided with a pin locking mechanism, as provided on the lowermost/innermost pole section and pole anchoring sleeve, to facilitate relative adjustment of the telescoping pole sections. After the height of the backboard structure has been set, the inflatable pole cushioning sleeve 6 can be pulled downwardly against the disc-like flange 4E and then inflated with air to a proper air pressure level using any conventional inflating device (e.g. mouth-operated inflating tube, hand-pump, etc.).

After the basketball system of the illustrative embodiment has been assembled and installed in the manner described above, it can be used to play all sorts of basketball games having various types of regulations. Some games may require strict rules on boundary conditions of game play, and others may not. Some games involve a single basketball system installation for half-court type play, as shown in FIG. 1, whereas other games may involve two such systems for use in full-court type play. In any such game, the wind-transmissive backboard allows players to make bank-type shots as in conventional hard-floor basketball play, without the risk of normal air-currents along the beach and shoreline, on a breezy seasonal day, blowing down the backboard structure, posing a risk of danger to both players and nearby spectators.

After a basketball play session is finished, the basketball system of the present invention may remain installed within the saturated bed of sand, or in most situations, quickly dismantled, and the components thereof reconfigured on the rear surface of the backboard structure, as shown in FIGS. 2E1 and 2E2, and described above.

In FIG. 3, an alternative embodiment of the transportable basketball system of the present invention is shown. As shown, the transportable basketball system 10 comprises a number of subcomponents, namely: a wind-transmissive backboard structure 2; a basketball hoop structure 3' and associated net 3K; a sectional-type pole assembly 4'; a sand-based pole anchoring assembly 5; and an inflatable pole-cushioning sleeve 6' disposed about a substantial portion of the pole assembly 4'. While the backboard structure 2 and inflatable pole-cushioning sleeve 6' shown in FIG. 3 are substantially similar to the backboard structure of FIG. 1, the other components of the system are somewhat different as described below.

As shown in FIG. 3A, the pole assembly 4' of the second illustrative embodiment comprises a set of sectional tubes 4A' through 4D' which are intercoupled in a conventional manner. In general, each pole can be made of metal, plastic, fiberglass or other material, and the interior core of each pole section can be filled with a low density foam material to provide buoyancy properties thereto so that the pole sections will float on water, in the event that they are introduced thereinto, for whatever reason. The first pole section 4A' is releasably affixed to the rear surface of the backboard frame 2A, along the longitudinal axis of the backboard structure using a pair of tube locking devices 4H1 and 4H2 permanently affixed to the rear of the backboard frame 2A, as shown in FIG. 3A. Each tube locking device 4H1 and 4H2 embodies a spring-biased locking mechanism with an actuable handle 4J.

In the illustrative embodiment, the height of the backboard 2 is about three feet (36") and so is the length of the first pole section 4A' is substantially the same as this height dimension. The second, third and fourth pole sections 4B', 4C' and 4D' are each about three feet in length, and have a tube coupling/locking device 41 having a spring-biased locking lever 4L which, when depressed down against a spring-biasing force, locks into an adjacent pole section that has been slid (i.e. telescoped) thereinto by a predetermined amount. When the pole sections are interconnected into each other as shown in FIG. 3A, an interconnected pole assembly of about nine feet in length securely supports the backboard structure 2. Depending on the application at hand, only one, two or three pole sections can be used to support the backboard structure above the sand surface.

Figure 3C:
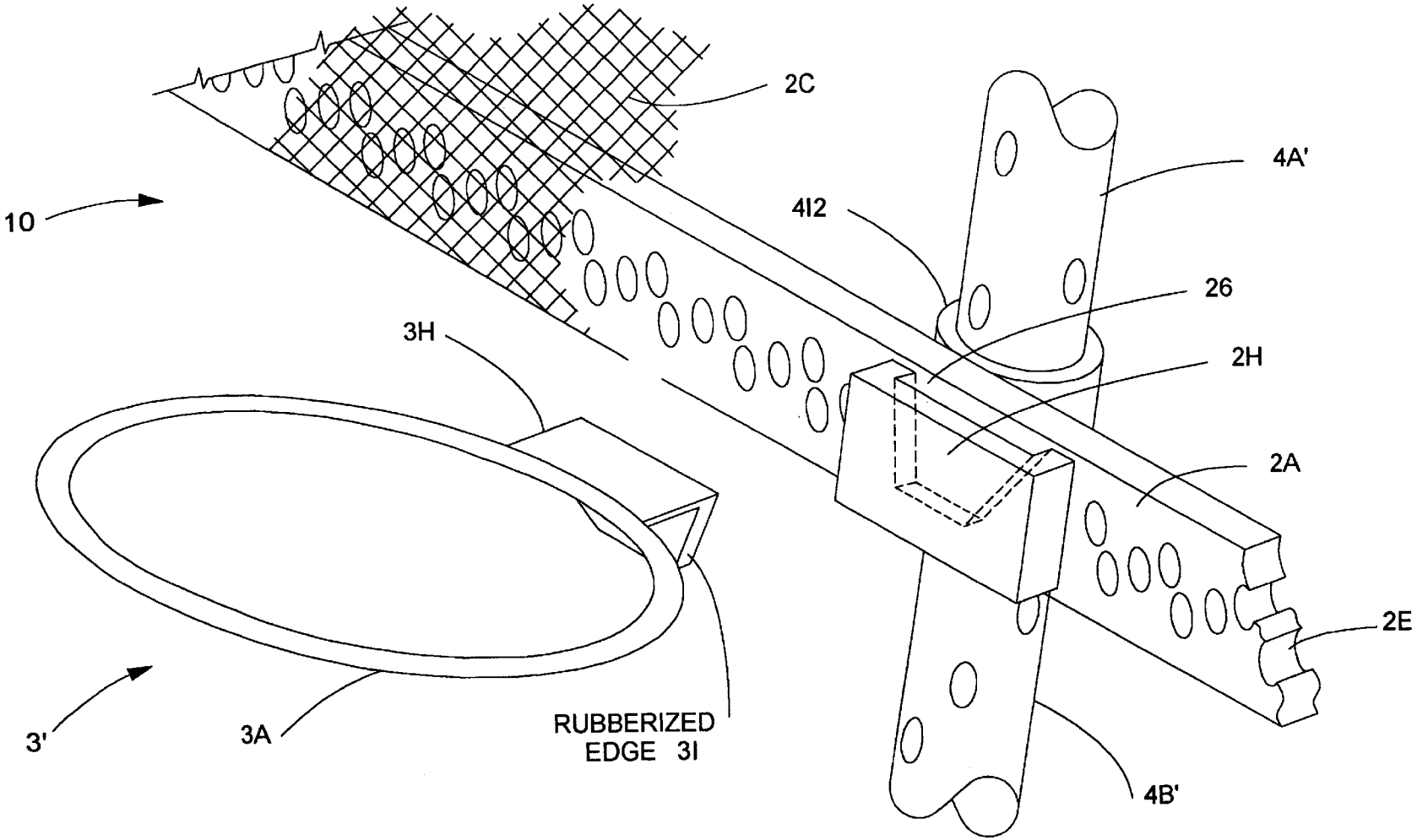
FIG. 3C is a perspective, partially cut-away view of a second illustrative embodiment of the wind-transmissive backboard structure of the present invention utilizable a second illustrative embodiment of the system of FIG. 3A, showing a basketball hoop structure design to be releasable removed from a support recess formed on the frame portion of the backboard structure of the illustrative embodiment.

As shown in FIG. 3C, the lower front portion of the backboard frame 2A has a hoop structure support receptacle or socket 26 that is securely formed in a mounting plate 2H permanently affixed to the lower central portion of the backboard frame structure 2A. As shown, the basketball hoop structure of the illustrative embodiment comprises: a circular-type hoop (i.e. rim) structure 34; a base support plate 3H that is integrally connected to a portion of the hoop structure 3A, in a conventional manner; and a downwardly directed mounting plate 3I that is integrated with the support plate 3H and designed to fit snugly within the support socket 26 formed in the mounting plate 2H, in a releasable manner. In this illustrative embodiment, the hoop structure support socket 26 is realized by a trapezoidally shaped groove formed within a block of solid material centrally protruding from the lower front surface of the backboard frame structure 24. The thickness of the groove is on the order of about a ½ inch but may be thicker or thinner depending on the particular embodiment of the present invention. In this illustrative embodiment, the downwardly directed mounting plate 3I is coated with a rubberized plastic material so that it fits snugly within the trapezoidally shaped groove 26, and becomes more securely engaged therewithin as downward force is applied to the rim, as naturally occurs when playing basketball with the system. To remove the hoop structure 3A from the support groove 26, a gentle tap under the base plate 3H is all that is necessary.

In order to arrange the basketball system in its transport configuration, the hoop structure 3A is releasably removed from the backboard structure by striking the underside of the rim, near the base support plate 3H. When releasably disconnected from the backboard, the hoop and rim structure is snapped-fitted to the rear surface of the backboard structure, via hoop retaining clips 11A and 11B, as shown in FIGS. 3D1 and 3D2.

In FIGS. 3D1 and 3D2, the transportable basketball system of FIG. 3 is shown disassembled and arranged into its transport configuration. As shown, the disassembled pole sections 4A' through 4D' and anchor sleeve 5A are releasably held against the rear of the backboard structure by five pairs of pole retaining clips 12A and 12B that are integrated with the rear surface of the backboard frame structure. In this configuration, the hoop structure 3A' is removed from the trapezoidal support groove 2G, and is clamped to the rear surface of the backboard frame structure 2A by hoop retaining clips 11A and 11B which are integrally formed on the upper rear surface of the backboard frame, as shown in FIG. 3D1. When arranged in the transport configuration shown in FIGS. 3D1 and 3D2, a handle-like structure 12 is formed on the top portion of the backboard frame structure 2A by the portion of the hoop structure 3A', retained on the rear surface of the backboard structure while arranged in this transport configuration. This handle portion 12 can be used to transport the configured system to and from the beach or shoreline. Optionally, the configured system shown in FIG. 3D1 can be placed within a flexible carrying case 8 through which the integrated handle 12 projects for carrying purposes. If necessary, the bottom portion of the carrying case can be provided with perforations to permit residual sand to escape from the carrying case from the system after it has been washed off with clean water.

Having described the structure and function of the subcomponents of the system of the illustrative embodiment shown in FIGS. 3 through 3D2, it appropriate to now describe how to install the system in its play configuration.

Typically, the user will transport the basketball system in its transport configuration to a play site where it is then rearranged for installation. First, the user removes the pole anchoring sleeve 5A from the rear-side of the backboard structure. Then, as described above, the pole-anchoring sleeve 5A is screwed into and beneath the sand by manually working the tool with a twisting and turning action while applying downwardly directed force, as provided by the weight of the user's body. When the pole sleeve has been driven beneath the sand, the lowermost pole section 4D' is driven into the sand filled interior volume 5B of the sleeve to about 12 inches in depth until the pole locking pin 4F registers with and snaps through the pole locking aperture 5E in the sleeve, thereby locking these components to each other and fixing the height of the lowermost pole section relative to the beach surface. Then, water is poured about the foundation of pole anchoring sleeve 5A buried beneath the sand, to saturate the sand thereabout and increase the frictional forces between the grains of sand about the sleeve structure 5A to greatly increase stability of the associated pole assembly.

Then the pole sections 4A' through 4D' are removed from the rear of the backboard structure and configured together to assemble a pole assembly connected to the backboard structure, as shown in FIG. 3A. Then the deflated pole cushioning sleeve 6' is slid over the lowermost pole section 4D'. Then, the free end of the pole assembly (i.e. section 4C') is locked into the lowermost pole section 4D' which has been previously locked into the installed pole anchoring sleeve 5A. If necessary, the height of the backboard structure 2A, relative to the beach surface beach, can be adjusted by removing or adding one more pole sections from the pole assembly. After the height of the backboard structure has been set, the inflatable pole cushioning sleeve 6' can be pulled downwardly against the bottom edge of the backboard and snapped into place with suitable fasteners, and then inflated with air to a proper air pressure using any conventional inflating device (e.g. mouth-operated inflating tube, hand-pump, etc.).

After the basketball system of the illustrative embodiment has been assembled and installed in the manner described above, it can be used to play all sorts of basketball games having various types of regulations. After a basketball play session is finished, the basketball system of the present invention may remain installed within the saturated bed of sand, or in most situations, quickly dismantled, and the components thereof reconfigured on the rear surface of the backboard structure, as shown in FIGS. 2D1 and 2D2, and described above.

Figure 4:
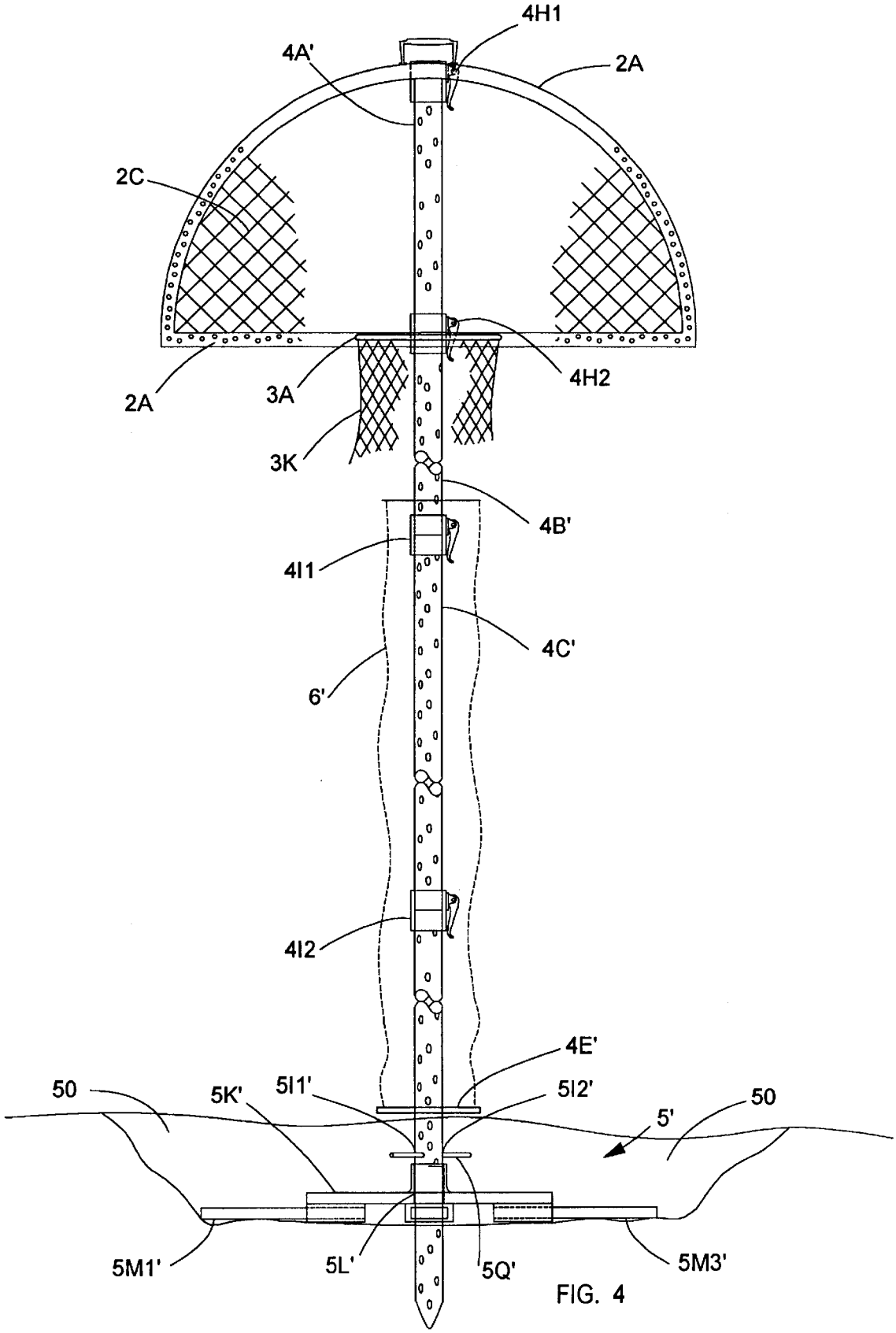
FIG. 4 is an elevated side view of a third illustrative embodiment of the transportable basketball system of the present invention, showing a wind-transmissive backboard structure, a basketball hoop and net structure, and a pole anchorable assembly configured together so as to enable the safe playing of basketball-related games on beaches, shorelines and other sand-covered outdoor environments.

In FIG. 4, the basketball system of FIG. 1 is shown with an alternative sand-based pole anchoring assembly 5'. As shown in FIG. 4, the pole anchoring subsystem 5' comprises: a pole anchoring base plate 5K' having a central hole 5L' and slots 5M' arranged over the surface of the base plate; a plurality of pole stabilizing plates 5N1 through 5N4 for insertion into the slots and projecting outwardly from and within substantially the same plate as the pole anchoring plate 5K'; and a plurality of apertures 5P' formed through the pole anchoring base plate 5K' and the pole stabilizing plates, permitting sand to flow therethrough when it is buried beneath a bed of sand 50, improving the anchoring characteristics of the pole anchoring subsystem when buried beneath a bed of water saturated sand. During installation, the pole stabilizing plates 5N1 through 5N4' are slid into the slots 5M1' through 5M4' of the pole anchoring base plate 5K', as shown in FIGS. 4A1 and 4A2. After a hole (i.e. pit) is properly excavated in the sand to a proper depth (e.g. 15 to 24 inches or less depending on the density of sand), the pole anchoring base plate is placed on the bottom of the excavated pit, as shown in FIG. 4. Then a perforated, cone tipped pole section 4E is inserted through central aperture 5L, to a desired depth, and then a drift-limiting pin 5Q is inserted through the pole section above the base plate, as shown, to prevent the pole section 4E' and the pole assembly connected thereto from drifting below the base plate during basketball play. Thereafter, the excavated pit is backfilled with sand and saturated with water to securely anchor the pole assembly within the bed of sand.

Figure 5:
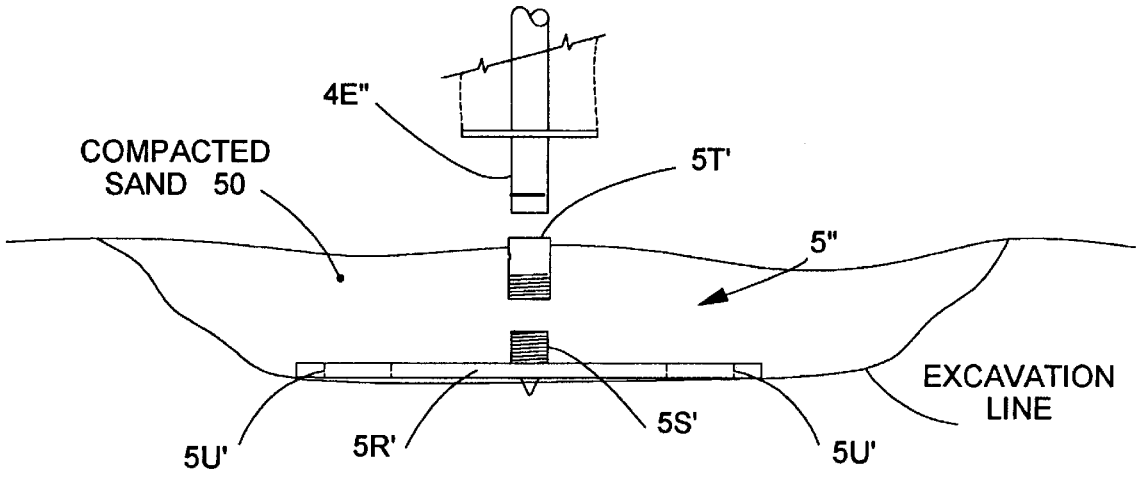
FIG. 5 is an elevated, partially broken away side view of a fourth illustrative embodiment of the transportable basketball system of the present invention, wherein a break-away resilient coupling is used to connect a base anchoring plate to the pole assembly of the system.

In FIG. 5, an alternative pole anchoring subsystem 5" is provided for the transportable basketball systems shown in FIGS. 1, 3 and 4. As shown, the pole anchoring subsystem comprises: a pole anchoring base plate 5R' having a short post portion 5S' projecting upwardly therefrom; a rubber coupling 5T for coupling the post portion 5S' and the lowermost pole section 4E" of the pole assembly; and a plurality of apertures 54' formed through the pole anchoring base plate 5R' permitting sand to flow therethrough when it is buried beneath a bed of sand, thus improving the stability of the pole anchoring subsystem. During installation, a hole (i.e. pit) is properly excavated in the sand to a proper depth (e.g. 18 to 22 inches), and the pole anchoring base plate 5R' is placed on the bottom of the excavated pit, as shown in FIG. 5. Then, the rubber coupler 5T' is used to connect the lowermost pole section 4E" to the post 5S' projecting from the base plate. Thereafter, the excavated pit is backfilled with sand and saturated with water to securely anchor the pole assembly within the bed of sand.

Figure 6:
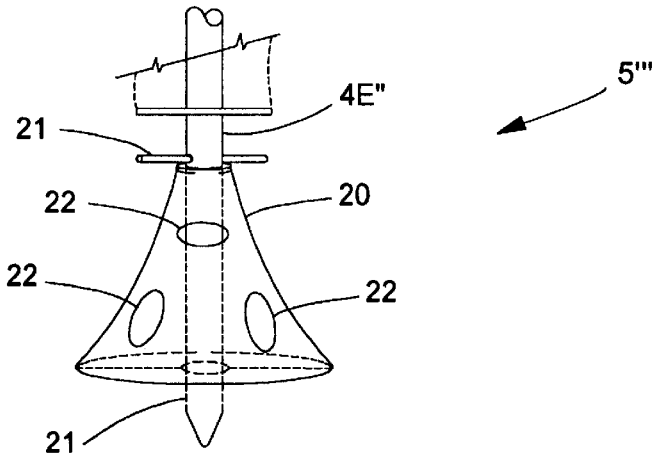
FIG. 6 is a side view of an alternative pole anchoring subsystem for use with any of the transportable basketball system of the present invention, showing a hollow sand-fillable structure, for stabile supporting the backboard pole assembly thereof within a bed of water-saturated sand.

In FIG. 6, another pole anchoring subsystem 5'"is shown for use with the backboard structure and pole assemblies of FIGS. 1, 3 and 4. In this embodiment, the anchoring subsystem is realized as a hollow volumetric structure 20 having a longitudinally extending central core 21 through which a cone tipped pole section 4E" is inserted therethrough to a desired depth and a drift-preventing pin 21 is passed, as shown in FIG. 4. As shown, the hollow volumetric structure has a plurality of holes 22 formed therethrough. permitting sand to flow therethrough when it is buried beneath a bed of sand 50, improving the anchoring characteristics of the pole anchoring subsystem when buried beneath a bed of water saturated sand. During installation, a hole (i.e. pit) is properly excavated in the sand to a proper depth (e.g. 18 to 22 inches), and the cone-tipped pole section 4E" is passed through the longitudinal core of the volumetric structure 20, and then the assembly is placed on the bottom of the excavated pit. Then, the pole section 4E" is driven into the sand to a desired depth, and then a drift-limiting pin 21 is inserted through the pole section above the volumetric structure, as shown, to prevent the pole section 4E" and the pole assembly connected thereto to drift below the volumetric structure during basketball play. Thereafter, the excavated pit is backfilled with sand and saturated with water to securely anchor the pole assembly within the bed of sand.

Figure 7B:
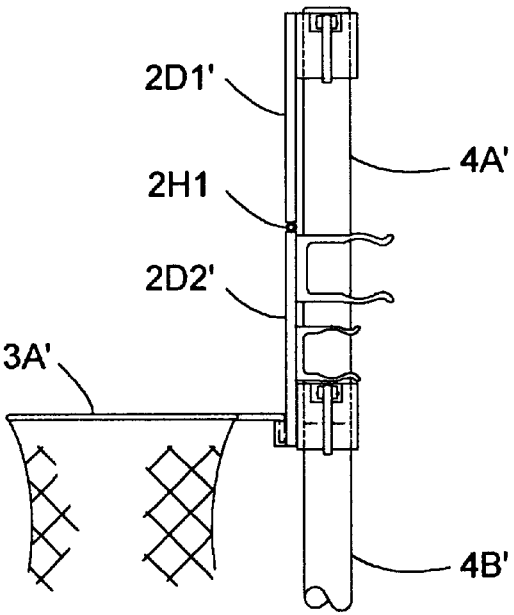
FIG. 7B is an elevated side view of the basketball system of FIG. 7A.
Figure 7A:
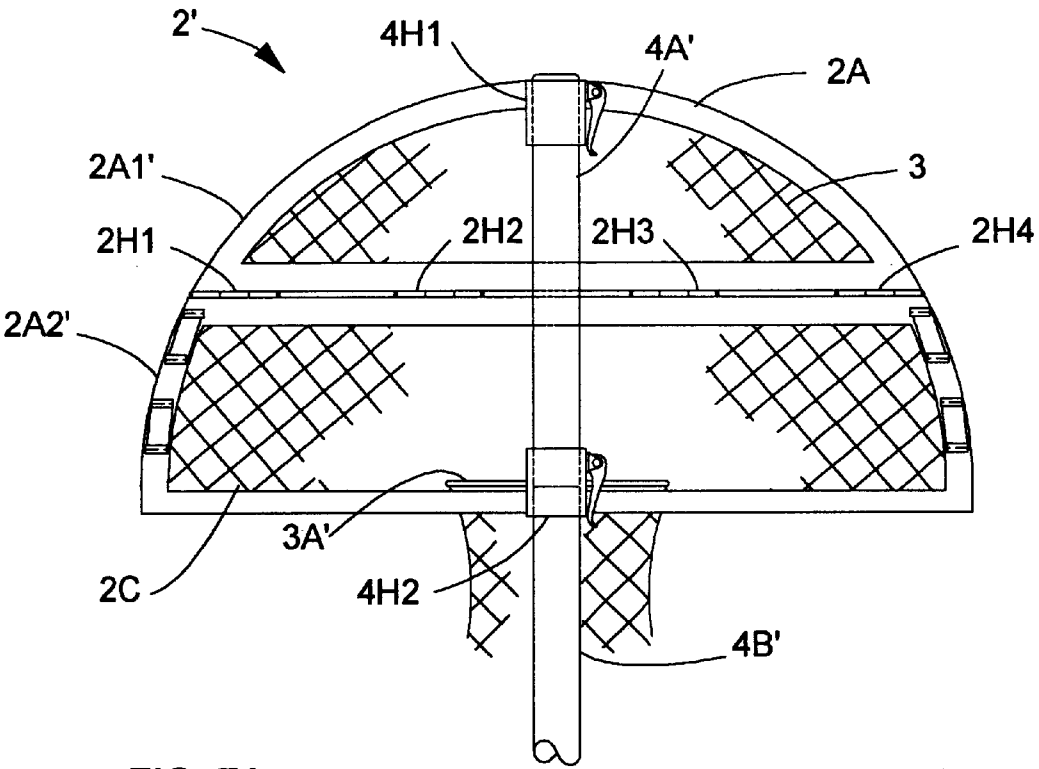
FIG. 7A is a rear, partially broken away view of an alternative embodiment of the basketball system of FIG. 3A, wherein the wind-transmissive backboard structure thereof comprises to a pair of wind-transmissive panels hingedly connected together and maintained in a single plane when the pole assembly is installed within the post clamping mechanisms associated with these panels.

FIGS. 7A through 7D show an alternative embodiment of the transportable basketball system of the present invention. As shown, the system comprises a wind-transmissive backboard structure 2' having a pair of wind-transmissive panels 2A1' and 2A2'. These panels provide a pair of partial backboard surfaces 2D1 and 2D2, that are hingedly connected together by hinge mechanisms 2H1 through 2H4, embodied within there panels so that the smooth planar surfaces of each of these panels establish surface to surface contact when the system is arranged in its transport condition, as shown in FIGS. 7A and 7B. As shown in FIGS. 7A and 7B, a pair of post clamping mechanisms 2H1 and 2H2, as employed in the system of FIG. 3, are permanently fixed to the rear surface of backboard panels 2A1 and 2A2', so that a pole assembly 4, as employed in the system of FIG. 1, can be passed through and retained by these clamping mechanisms when backboard panels are arranged in the play configuration, as shown in FIGS. 7A and 7B. In the play configuration, pole sections 4A through 4D are telescopically extended and locked to support the foldable backboard assembly at a desired height above the sand covered ground. While not shown, the same pole anchoring device 5 employed in the system of FIG. 1 is employed to anchor the extended pole and backboard assembly in its play configuration.

Figure 7C:
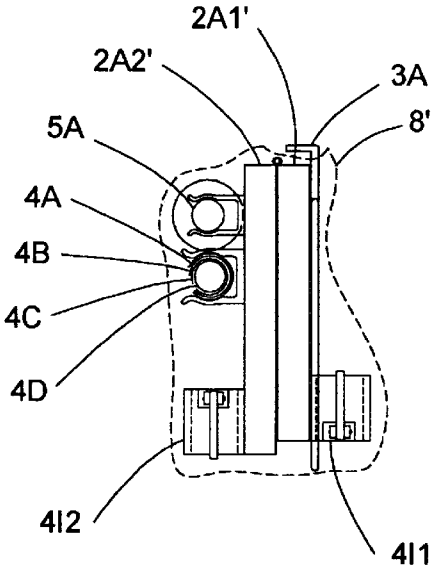
FIG. 7C is a rear side view of the basketball system of FIG. 7A shown with its upper backboard panel folded down against the lower backboard panel, the basketball hoop structure folded up and back against the folded down upper backboard panel, and the pole sections and pole anchoring sleeve releasably retained against the rear surface of the lower backboard panel, so that the system is arranged in its transport configuration, to provide an ultra-compact light-weight unit for transport between sand covered outdoor environments and remote locations.
Figure 7D:
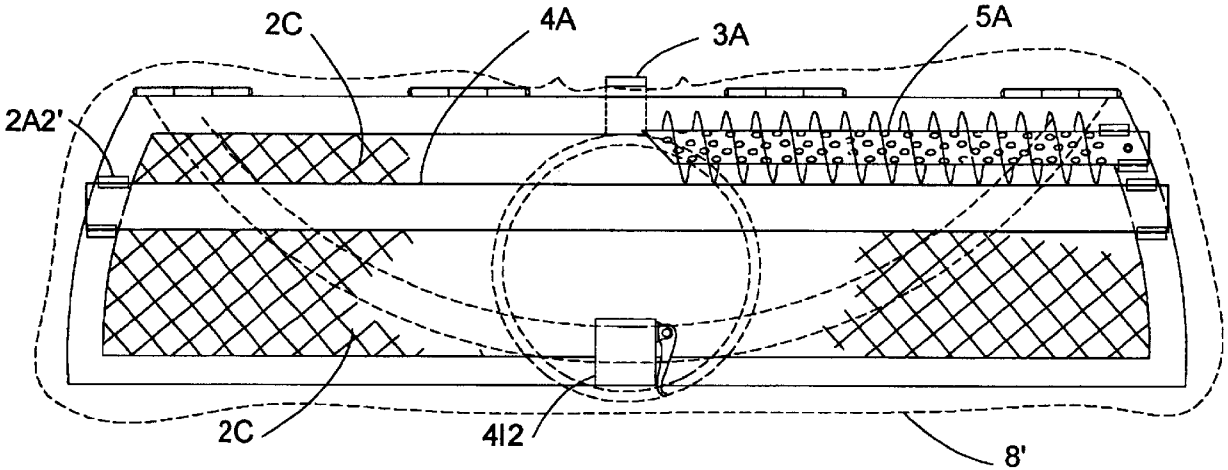
Figure 8B:
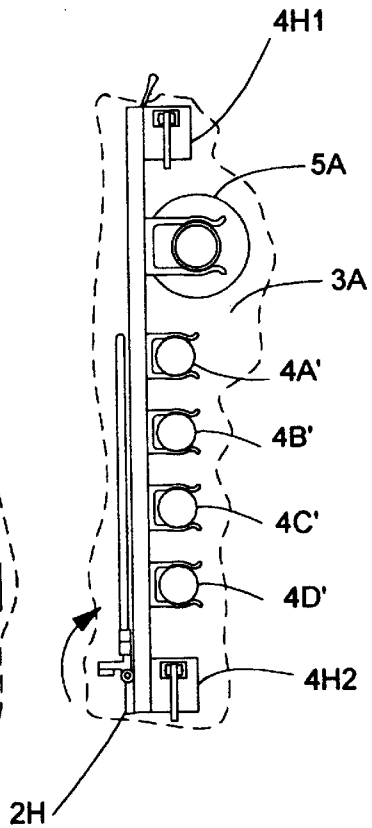
FIG. 8B is an elevated side view of the basketball system shown in FIG. 8A, arranged in its transport configuration.
Figure 8A:
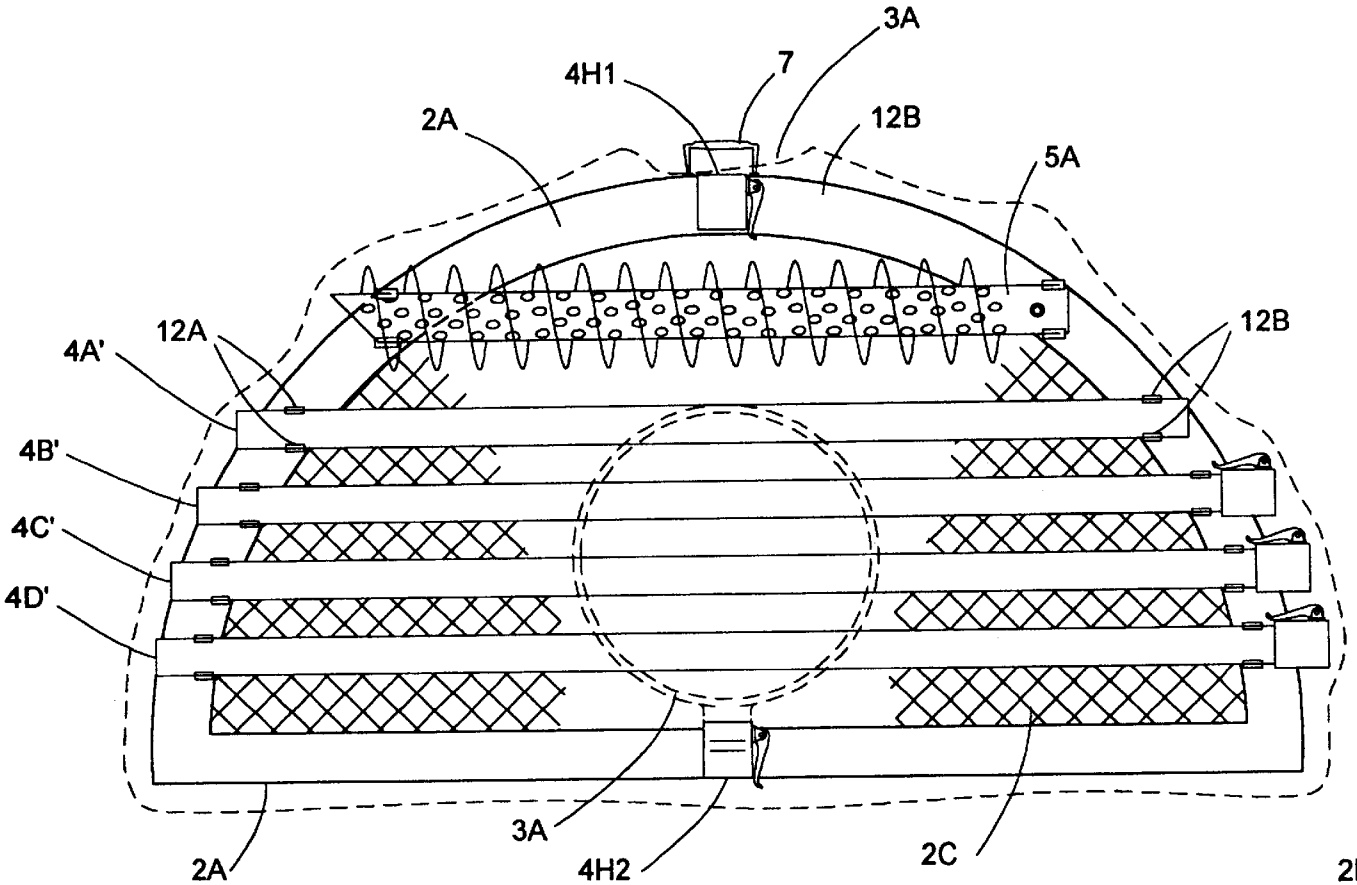
FIG. 8A is an elevated side view of an alternative embodiment of the basketball structure of the present invention arranged in its transport configuration, wherein the wind-transmissive backboard structure shown in FIG. 3A is employed in the basketball system of FIG. 1.

FIGS. 7C and 7D show the basketball system of FIGS. 7A and 7B arranged in its transport configuration. In order to arrange the basketball system into its transport configuration, the following operations are carried out in the following order, namely: the upper backboard panel 2A' is folded down against the lower backboard panel 2A2'; the basketball hoop structure 3A is folded up and back against the folded down upper backboard panel; the pole sections 4A through 4D are telescopically retracted and then the pole encasing tube 4A is releasably retained against the rear surface of the folded backboard assembly by a first set of retaining clips; and the pole anchoring sleeve 5A is releasably retained against the rear surface of the lower backboard panel by a second set of retaining clips provided on either pole enclosing tube 4A of the backboard frame. When arranged in its transport configuration, the upper portion of the folded down hoop structure 3A forms a handle that can be used to carry the ultra-compact lightweight unit between sand covered outdoor play environments and remote locations. Optionally, the unit can be placed in a plastic carrying bag 8' for storage and transportation purposes.

Each of the system components described above in connection with one illustrative embodiment can be interchanged with other system components provided in other illustrative embodiments. Thus, for example, the sectional pole embodiment of FIG. 3 can be modified to use the releasable hoop and rim structure shown in the embodiment of FIG. 1 to provide the transportable basketball system of FIGS. 8A and 8B. Similarly, the telescopic pole embodiment of FIG. 1 can be modified to use the releasable hoop and rim structure shown in the embodiment of FIG. 3 to provide the transportable basketball system with such features.

FIG. 9 shows a first illustrative embodiment of the basketball construction of the present invention, designed for optimal use with any of the transportable basketball systems of the present invention. Preferably, this ball construction is realized using 1 to 2 inches of light-weight foam sponge material, glued to a hard plastic spherical shell. For a 12 inch hoop structure, the preferred ball diameter would be about 10 inches.

FIG. 10 shows a second illustrative embodiment of the basketball construction of the present invention designed for use optimal use with the transportable basketball systems of the present invention. As shown, this ball 40 is realized as two semi-spherical halves 41 and 42, and fastened together by Velcro® brand fastening material 43. For a 12 inch hoop structure, the preferred ball diameter would be about 1.2 inches.

FIG. 11 shows a third illustrative embodiment of the basketball construction of the present invention 50 designed for optimal use with the transportable basketball systems of the present invention. Preferably, this ball construction 50 is realized by two hollow semi-spherical halves 51A and 51B bearing 1 to 2 inch light-weight foam sponge coating material 52A and 52B, and fastened together using Velcro® brand fastening material 53. For a 12 inch hoop structure the preferred ball diameter would be about 10 inches.

Having described the illustrative embodiments of the present invention, it is understood that many modifications and variations thereof will readily come to mind having had the benefit of reading the present invention disclosure.

For example, there are many alternative ways of connecting the hoop structure of the present invention to the backboard structure thereof in a releasable manner. One alternative hoop mounting technique might involve providing a set of bolts or projections on the hoop base plate, passing these bolts or projections through a set of predrilled (i.e. registered) holes formed in the backboard structure, and then securing these bolts or projections with set of wing-type nuts or some other locking mechanism so that the hoop structure is releasably secured to the backboard structure during the play configuration. However, such techniques are thought to be less preferred to the techniques employed in the illustrative embodiments of the present invention, described above.

Several modifications to the illustrative embodiments have been described above. It is understood, however, that various other modifications to the illustrative embodiment of the present invention will readily occur to persons with ordinary skill in the art. All such modifications and variations are deemed to be within the scope and spirit of the present invention as defined by the accompanying Claims to Invention.

What is claimed is:

1. A portable basketball system for use in playing basketball-related games on sand covered outdoor environments, comprising:

a wind-transmissive backboard structure having a backboard surface disposed substantially within a first plane, bounded by a frame structure, and characterized by a high degree of air permeability across said backboard surface so that air currents, expected in said sand covered outdoor environments, can pass through said backboard surface with minimal resistance yet deflect a lightweight basketball when tossed thereagainst during basketball-related games;

wherein said wind-transmissive backboard structure includes a mesh material stretched tightly about and fastened to said frame structure so as to form a planar backboard surface which presents minimal resistance to expected air currents present on the beach or along a shoreline, and undergoes minimal surface distortion when said lightweight basketball is bounced off the backboard surface during said basket-ball related games;

a basketball hoop structure defining an opening through which a basketball can be passed during said basketball-related games, and generally disposed within a second plane substantially perpendicular to said first plane;

a pole assembly, including a plurality of arrangeable pole sections, for supporting said wind-transmissive backboard structure at a height above the surface of a sand bed located in said sand covered outdoor environments; and a pole anchoring device for driving beneath said sand bed and supporting said pole assembly in a substantially plumb orientation, while playing said basketball-related games;

wherein said pole anchoring device further includes a set of sand-engaging threads formed on the external surface of said pole anchoring sleeve, and a set of handle structures provided on said pole anchoring sleeve, enabling a user to rotate said pole anchoring device while pushing said pole anchoring device into said sand bed, thereby screwing said pole anchoring sleeve beneath said sand bed.

2. The portable basketball system of claim 1, wherein said basketball hoop structure is hingedly connected to said frame structure; and wherein during said transport configuration, the second plane of said basketball hoop structure is orientable substantially parallel to the first said backboard surface, said pole sections of said pole assembly are contained within a pole enclosing tube; and whereby said portable basketball system is arranged for transport between said sand covered outdoor environment and said remote location.

3. A portable basketball system for use in playing basketball-related games on sand covered outdoor environments, comprising:

a wind-transmissive backboard structure having a backboard surface disposed substantially within a first plane, bounded by a frame structure, and characterized by a high degree of air permeability across said backboard surface so that air currents, expected in said sand covered outdoor environments, can pass through said backboard surface with minimal resistance yet deflect a lightweight basketball when tossed thereagainst during basketball-related games;

wherein said wind-transmissive backboard structure includes a mesh material stretched tightly about and fastened to said frame structure so as to form a planar backboard surface which presents minimal resistance to expected air currents present on the beach or along a shoreline, and undergoes minimal surface distortion when said lightweight basketball is bounced off the backboard surface during said basket-ball related games;

a basketball hoop structure defining an opening through which a basketball can be passed during said basketball-related games, and generally disposed within a second plane substantially perpendicular to said first plane;

a pole assembly, including a plurality of telescopically-connected tubes which are intercoupled using telescopic linking mechanisms, for supporting said wind-transmissive backboard structure at a height above the surface of a sand bed located in said sand covered outdoor environments; and a pole anchoring device for driving beneath said sand bed and supporting said pole assembly in a substantially plumb orientation, while playing said basketball-related games;

wherein said pole assembly;

wherein said pole anchoring device further includes a set of sand-engaging threads formed on the external surface of said pole anchoring sleeve, and a set of handle structures provided on said pole anchoring sleeve, enabling a user to rotate said pole anchoring device while pushing said pole anchoring device into said sand bed, thereby screwing said pole anchoring sleeve beneath said sand bed.

4. The portable basketball system of claim 3, wherein said basketball hoop structure is hingedly connected to said frame structure.

5. A portable basketball system for use in playing basketball-related games on sand covered outdoor environments, comprising:

a wind-transmissive backboard structure having a backboard surface disposed substantially within a first plane, bounded by a frame structure, and characterized by a high degree of air permeability across said backboard surface so that air currents, expected in said sand covered outdoor environments, can pass through said backboard surface with minimal resistance yet deflect a lightweight basketball when tossed thereagainst during basketball-related games;

wherein said wind-transmissive backboard structure includes a mesh material stretched tightly about and fastened to said frame structure so as to form a planar backboard surface which presents minimal resistance to expected air currents present on the beach or along a shoreline, and undergoes minimal surface distortion when said lightweight basketball is bounced off the backboard surface during said basket-ball related games;

a basketball hoop structure defining an opening through which a basketball can be passed during said basketball-related games, and generally disposed within a second plane substantially perpendicular to said first plane; and a pole assembly for supporting said wind-transmissive backboard structure at a height above the surface of a sand bed located in said sand covered outdoor environments;

a pole anchoring device for driving beneath said sand bed and supporting said pole assembly in a substantially plumb orientation, while playing said basketball-related games;

wherein said pole anchoring device comprises:

a pole anchoring sleeve having a hollow inner volume for receipt of sand and a portion of said pole assembly;

a plurality of perforations formed through said pole anchoring sleeve, permitting the passage of grains of said sand into said hollow inner volume when said pole anchoring sleeve is driven beneath said sand bed;

a set of sand-engaging threads formed on the external surface of said pole anchoring sleeve; and a set of handle structures provided on said pole anchoring sleeve, enabling a user to rotate said pole anchoring device while pushing said pole anchoring device into said sand bed, thereby screwing said pole anchoring sleeve beneath said sand bed.

6. The portable basketball system of claim 5, wherein said pole assembly further comprises a pole anchoring pin formed on an innermost telescopically-connected pole section, and said pole anchoring sleeve having an aperture for receiving said pole anchoring pin when the innermost telescopically-connected pole section is inserted within said hollow inner volume of said pole anchoring sleeve, thereby locking said pole assembly to said pole anchoring device.

* * * * *

UNITED STATES PATENT AND TRADEMARK OFFICE

CERTIFICATE OF CORRECTION

PATENT NO. : 6,743,125 B2 
DATED : June 1, 2004
INVENTOR(S) : Raymond O'Neill and Raymond O'Neill, Jr.

It is certified that error appears in the above-identified patent and that said Letters Patent is hereby corrected as shown below:

Title page, Item [54] and Column 1, lines 1-4,
Title, should read -- TRANSPORTABLE BASKETBALL SYSTEM HAVING WIND-TRANSMISSIVE MESH BACKBOARD STRUCTURE AND SAND-ANCHORABLE POST ASSEMBLY WITH THREADS AND HANDLES FOR SAFE, SIMPLE AND QUICK INSTALLATION ALONG BEACHES SHORELINES AND OTHER SAND-COVERED OUTDOOR ENVIRONMENTS --

Signed and Sealed this

Tenth Day of August, 2004

JON W. DUDAS
*Acting Director of the United States Patent and Trademark Office*